US008881568B2

(12) United States Patent
Nakata et al.

(10) Patent No.: US 8,881,568 B2
(45) Date of Patent: Nov. 11, 2014

(54) COOLING EQUIPMENT AND COOLING METHOD FOR HOT ROLLED STEEL PLATE

(75) Inventors: Naoki Nakata, Fukuyama (JP); Akio Fujibayashi, Kawasaki (JP); Hiroyuki Fukuda, Fukuyama (JP); Kenji Hirata, Kurashiki (JP); Takayuki Furumai, Fukuyama (JP); Yukio Fujii, Fukuyama (JP); Motoji Terasaki, Tokyo (JP)

(73) Assignee: JFE Steel Corporation (JP)

( * ) Notice: Subject to any disclaimer, the term of this patent is extended or adjusted under 35 U.S.C. 154(b) by 645 days.

(21) Appl. No.: 13/003,970

(22) PCT Filed: Jul. 15, 2009

(86) PCT No.: PCT/JP2009/063142

§ 371 (c)(1),
(2), (4) Date: Mar. 14, 2011

(87) PCT Pub. No.: WO2010/008090

PCT Pub. Date: Jan. 21, 2010

(65) Prior Publication Data

US 2011/0162427 A1 Jul. 7, 2011

(30) Foreign Application Priority Data

| | | |
|---|---|---|
| Jul. 16, 2008 | (JP) | 2008-184585 |
| Jul. 16, 2008 | (JP) | 2008-184586 |
| Sep. 10, 2008 | (JP) | 2008-231821 |
| Jul. 8, 2009 | (JP) | 2009-161704 |
| Jul. 8, 2009 | (JP) | 2009-161705 |

(51) Int. Cl.
*B21B 27/06* (2006.01)
*B21B 45/02* (2006.01)

(52) U.S. Cl.
CPC ..... *B21B 45/0233* (2013.01); *B21B 45/0218* (2013.01)
USPC ..... 72/201; 266/113; 72/342.2

(58) Field of Classification Search
USPC ..... 72/201, 342.1, 342.2, 342.5, 342.6, 72/200, 202, 236; 266/113
See application file for complete search history.

(56) References Cited

U.S. PATENT DOCUMENTS

| | | | | |
|---|---|---|---|---|
| 6,054,095 | A * | 4/2000 | Minato et al. | 266/81 |
| 2006/0060271 | A1 * | 3/2006 | Fujibayashi et al. | 148/638 |

FOREIGN PATENT DOCUMENTS

| | | | |
|---|---|---|---|
| EP | 1 527 829 | A1 | 5/2005 |
| JP | 59-001641 | A | 1/1984 |
| JP | 2002-239623 | A | 8/2002 |
| JP | 2004-066308 | A | 3/2004 |
| JP | 2006-035233 | A | 2/2006 |

* cited by examiner

*Primary Examiner* — Shelley Self
*Assistant Examiner* — Matthew G Katcoff
(74) *Attorney, Agent, or Firm* — DLA Piper LLP (US)

(57) ABSTRACT

Cooling equipment for a hot rolled steel plate which is arranged on a hot rolling line of a steel plate includes an upper header which supplies cooling water to an upper surface of the hot rolled steel plate; upper cooling water jetting nozzles suspended from the upper header for jetting rod-like water flow; and an upper dividing wall arranged between the hot rolled steel plate and the upper header, wherein a plurality of upper water-supply inlets which allow insertion of lower end portions of the upper cooling water jetting nozzles thereinto, and a plurality of upper drain outlets which drain cooling water supplied to upper surface of the hot rolled steel plate on dividing wall are formed in the upper dividing wall.

20 Claims, 16 Drawing Sheets

COOLING EQUIPMENT AND COOLING METHOD FOR HOT ROLLED STEEL PLATE

RELATED APPLICATIONS

This is a §371 of International Application No. PCT/JP2009/063142, with an international filing date of Jul. 15, 2009 (WO 2010/008090 A1, published Jan. 21, 2010), which is based on Japanese Patent Application Nos. 2008-184585, filed Jul. 16, 2008, 2008-184586, filed Jul. 16, 2008, 2008-231821, filed Sep. 10, 2008, 2009-161704, filed Jul. 8, 2009, and 2009-161705, filed Jul. 8, 2009, the subject matter of which is incorporated by reference.

TECHNICAL FIELD

This disclosure relates to cooling equipment and a cooling method for a hot rolled steel plate.

BACKGROUND

In a process of manufacturing a steel plate such as a steel plate or a steel sheet by hot rolling, for example, in equipment shown in FIG. 8, water cooling or air cooling is applied to a steel plate (hot rolled steel plate) after hot rough rolling and hot finish rolling are performed, thus controlling the structure of the steel plate. When the steel plate is cooled to a relatively low temperature, for example, 450 to 650° C. by water cooling, the steel plate can acquire the fine ferrite or bainite structure so that the steel plate can ensure strength thereof. Accordingly, a technique which cools a steel plate by spray cooling water or laminar cooling water has been adopted in general. Recently, techniques which acquire a high cooling rate for making the structure of a steel plate finer thus enhancing strength of a steel plate have been developed vigorously.

For example, as a technique which cools a hot rolled steel plate by supplying a large quantity of columnar laminar cooling water, a technique disclosed in Japanese Patent Unexamined Publication 2002-239623 or Japanese Patent Unexamined Publication 2004-66308 is named. In this technique, cooling water is jetted to upper and lower surfaces of a steel plate at a high speed from a large number of nozzles. This technique acquires an extremely high cooling rate and is expected to manufacture a product having excellent material properties.

Also as another technique which cools a hot rolled steel plate by supplying cooling water to the steel plate, a technique disclosed in Japanese Patent Unexamined Publication 2006-35233 is named. In this technique, cooling water which is jetted from nozzles is filled in a region surrounded by a steel plate, rolls and side walls so that a pool is formed whereby a steady cooling state is acquired leading to the reduction of cooling deviation in the widthwise direction.

However, the prior art has problems in cooling ability and in ensuring cooling uniformity.

In the techniques disclosed in Japanese Patent Unexamined Publication 2002-239623 and Japanese Patent Unexamined Publication 2004-66308, cooling water which is jetted from a plurality of jetting nozzles passes through one hole or slit formed in a protective sheet arranged between a cooling water header and a hot rolled steel strip, and cooling water supplied to the steel strip is discharged through the same hole or slit. That is, the hole or the slit has both functions of a spout of nozzle and a drain outlet and, hence, as shown in FIG. 9, the flow of cooling drain is a backward flow for rod-like water flow jetted from ends of the nozzles and generates resistance to flow. Further, after reaching the steel plate, the drains rise while colliding with each other and their flow passages are bent before arriving at the drain outlet which also functions as the spout of the nozzle. Accordingly, this portion forms staying water so that the smooth flow of the drain is hindered. In this manner, it is found that the techniques disclosed in Japanese Patent Unexamined Publication 2002-239623 and Japanese Patent Unexamined Publication 2004-66308 have some difficulty in the smooth draining of cooling water supplied to a surface of a steel strip. Accordingly, to enable cooling water to surely reach the steel plate, it is necessary to apply a high injection pressure to the header to perform high-speed jetting of cooling water whereby this technique has a drawback that an equipment cost is pushed up.

Further, when a slit-shaped hole is formed, a portion of a protector plate between the slits has a narrow plate shape and, hence, the rigidity of the portion is lowered, and when a warped steel plate intrudes and collides with cooling equipment, there exists a possibility that the steel plate damages the equipment. Accordingly, although there arises no problem when a plate thickness of the steel plate which is subject to cooling processing is 2 to 3 mm, when the plate thickness becomes 15 mm or more, it is necessary to use a protector plate having a large thickness to prevent the equipment from being damaged, thus giving rise to a drawback that the formation of the slit becomes difficult.

Further, when slit-shaped holes having different sizes are formed, resistance to flow differs depending on a position of a nozzle and, hence, there also arises a drawback that the strip temperature deviation at cooling occurs in the widthwise direction of the steel plate.

The technique disclosed in Japanese Patent Unexamined Publication 2006-35233 adopts the structure where cooling water supplied to the upper surface of the steel plate forms a pool in a space surrounded by the steel plate, the roll and the side wall, and cooling water is discharged upward. Accordingly, it takes a considerable time to fill the space with cooling water and, hence, in a range of several meters from a leading edge of the steel plate, a state of cooling water becomes nonstationary, thus giving rise to a drawback that the strip temperature deviation or warping is liable to occur at the time of cooling the steel plate in the longitudinal direction.

Further, with respect to the technique disclosed in Japanese Patent Unexamined Publication 2006-35233, a case where the side wall is not provided is also disclosed. In this case, as indicated by an arrow indicated by a dotted line in FIG. 12, drain flows on a guide plate (indicated as a dividing wall in place of the guide plate in FIG. 12) in the direction toward a widthwise edge portion of the steel plate. In the technique disclosed in Japanese Patent Unexamined Publication 2006-35233, an end of the cooling nozzle is arranged above the guide plate and, hence, the widthwise directional flow of the drain interferes with cooling water jetted from the cooling nozzle.

The closer to the edge portion of the steel plate in the widthwise direction, the larger the widthwise flow of the drain becomes and, hence, the closer to the edge portion of the steel plate in the widthwise direction, the larger the interference becomes. Accordingly, a part of or the whole cooling water jetted from the cooling nozzle cannot reach the upper surface of the steel plate so that the uniform cooling in the widthwise direction cannot be achieved.

Further, in all techniques disclosed in Japanese Patent Unexamined Publication 2002-239623, Japanese Patent Unexamined Publication 2004-66308 and Japanese Patent Unexamined Publication 2006-35233, cooling water is jetted from above and below the steel plate. In a case where a steel plate to be cooled is not present such as a case where the steel plate has not yet entered the inside of a cooling device or a case where there are regions outside a plate width of a steel plate to be cooled, cooling waters which are jetted from above and below the steel plate collide with each other and splash to a periphery around the steel plate. Splashed water breaks a flux of cooling water jetted from the surrounding cooling nozzles thus giving rise to a drawback that stable cooling ability cannot be assured at a leading edge, a tailing edge and both edges of the steel plate in the widthwise direction.

Further, there may be a case where splashed water stays on the steel plate before the leading edge of the steel plate reaches a zone where cooling water is supplied and cools the leading edge of the steel plate, and there may be also a case where splashed water stays on the steel plate even after the tailing edge of the steel plate passes the zone where cooling water is supplied and cools the tailing edge of the steel plate. In such a case, the uniform cooling in the longitudinal direction cannot be achieved. Further, due to splashing of cooling water to the periphery around the steel plate, there exists a possibility that the measurement using various sensors cannot be performed or the maintenance property of peripheral equipment is deteriorated.

It could therefore be helpful to provide a technique which uniformly cools a hot rolled steel plate at a high cooling rate or at high thermal transmissivity when cooling water is supplied to an upper surface of the hot rolled steel plate or to a lower surface of the hot rolled steel plate.

SUMMARY

We thus provide:

(1) Cooling equipment for a hot rolled steel plate which is arranged on a hot rolling line of a steel plate, the cooling equipment including: an upper header which supplies cooling water to an upper surface of the hot rolled steel plate; upper cooling water jetting nozzles which are suspended from the upper header for jetting rod-like water flow; and an upper dividing wall which is arranged between the hot rolled steel plate and the upper header, wherein a plurality of upper water-supply inlets which allow the insertion of lower end portions of the upper cooling water jetting nozzles thereinto, and a plurality of upper drain outlets which drain the cooling water supplied to the upper surface of the hot rolled steel plate on the upper dividing wall are formed in the upper dividing wall.

(2) In the cooling equipment for a steel material having the constitution (1), the upper drain outlets are arranged at the circumcenter of a triangle which is formed of three line segments which connect the neighboring upper water-supply inlets to each other or a bisection point of each side of the triangle.

(3) In the cooling equipment for a steel material having the constitution (1), the upper drain outlets are arranged at the center of gravity of a quadrangle which is formed of four line segments which connect the neighboring upper water-supply inlets to each other or a bisection point of each side of the quadrangle.

(4) In the cooling equipment for a hot rolled steel plate having any one of the constitutions (1) to (3), both of a total cross-sectional area of the upper drain outlets formed in the upper dividing wall and a cross-sectional area of a flow passage in the steel-plate widthwise direction in a space surrounded by a lower surface of the upper header and an upper surface of the upper dividing wall are set to a value not less than 1.5 times a total inner-diameter cross-sectional area of the upper cooling water jetting nozzles.

(5) In the cooling equipment for a hot rolled steel plate having any one of the constitutions (1) to (4), a draining roll is arranged in front of and behind the upper header.

(6) In the cooling equipment for a hot rolled steel plate having any one of the constitutions (1) to (5), an inner diameter of the upper cooling water jetting nozzle is set to 3 to 8 mm, a length of the upper cooling water jetting nozzle is set to 120 to 240 mm, a distance from a lower end of the upper cooling water jetting nozzle to a surface of the hot rolled steel plate is set to 30 to 120 mm, a flow speed of the cooling water to be jetted from the upper cooling water jetting nozzles is set to 6 m/s or more, and more preferably to 8 m/s or more, and water amount density of the cooling water to be jetted from the upper cooling water jetting nozzles is set to 1.5 to 4.0 $m^3/(m^2 \cdot min)$.

(7) In the cooling equipment for a hot rolled steel plate having any one of the constitutions (1) to (6), a gap defined between an outer peripheral surface of the upper cooling water jetting nozzle inserted into the upper water-supply inlet formed in the upper dividing wall and an inner surface of the upper water-supply inlet is set to a value not more than 3 mm.

(8) In the cooling equipment for a hot rolled steel plate having any one of the constitutions (1) to (7), among the upper cooling water jetting nozzles which are arranged in the widthwise direction of the hot rolled steel plate, the cooling water jetting nozzles on a most upstream-side row in the conveyance direction of the hot rolled steel plate are inclined in the upstream direction in the conveyance direction of the hot rolled steel plate by 15 to 60 degrees, and the cooling water jetting nozzles on a most downstream-side row in the conveyance direction of the hot rolled steel plate are inclined in the downstream direction in the conveyance direction of the hot rolled steel plate by 15 to 60 degrees.

(9) In the cooling equipment for a hot rolled steel plate having any one of the constitutions (1) to (8), the cooling equipment includes, on a lower surface side of the hot rolled steel plate, a lower header which supplies cooling water and lower cooling water jetting nozzles which jet rod-like water flow upward in the vertical direction from the lower header, and the lower cooling water jetting nozzles are arranged such that jetting lines from the lower cooling water jetting nozzles penetrate the upper drain outlets formed in the upper dividing wall.

(10) In the cooling equipment for a hot rolled steel plate having the constitution (9), the cooling equipment further includes a lower dividing wall between the lower header and the hot rolled steel plate on the lower surface side of the hot rolled steel plate, and a large number of lower water-supply inlets which allows the insertion of upper end portions of the lower cooling water jetting nozzles thereinto and a large number of lower drain outlets which drain cooling water supplied to the lower surface of the hot rolled steel plate under the lower dividing wall are formed in the lower dividing wall, and the lower drain outlets which are formed in the lower dividing wall are arranged such that jetting lines from the upper cooling water jetting nozzles penetrate the lower drain outlets.

(11) In the cooling equipment for a hot rolled steel plate having the constitution (9), the cooling equipment further includes a protector plate which protects the lower cooling water jetting nozzles on the lower surface side of the hot rolled steel plate, and the protector plate is arranged at a position which avoids the jetting lines from the lower cooling water jetting nozzles and the jetting lines from the upper cooling water jetting nozzles such that the an upper end of the protector plate is disposed closer to the hot rolled steel plate than upper ends of the lower cooling water jetting nozzles.

(12) In the cooling equipment for a hot rolled steel plate having the constitution (9) or (11), an inner diameter of the upper cooling water jetting nozzle and an inner diameter of the lower cooling water jetting nozzle are set to 3 to 8 mm respectively, a flow speed of the cooling water to be jetted from the cooling water jetting nozzles is set to 6 m/s or more, and more preferably to 8 m/s or more, water amount density of the cooling water on an upper surface side of the hot rolled steel plate is set to 1.5 to 4.0 $m^3/(m^2 \cdot min)$, and water amount density of the cooling water on a lower surface side of the hot rolled steel plate is set to 2.0 to 6.0 $m^3/(m^2 \cdot min)$.

(13) In the cooling equipment for a hot rolled steel plate having the constitution (10), an inner diameter of the upper cooling water jetting nozzle and an inner diameter of the lower cooling water jetting nozzle are set to 3 to 8 mm respectively, a flow speed of the cooling water to be jetted from the cooling water jetting nozzles is set to 6 m/s or more, and more preferably to 8 m/s or more, and water amount densities of the cooling water on an upper surface side and a lower surface side of the hot rolled steel plate are set to 1.5 to 4.0 $m^3/(m^2 \cdot min)$ respectively.

(14) In the cooling equipment for a hot rolled steel plate having the constitution any one of the constitutions (9) to (13), among the lower cooling water jetting nozzles which are arranged in the widthwise direction of the hot rolled steel plate, the cooling water jetting nozzles on a most upstream-side row in the conveyance direction of the hot rolled steel plate are inclined in the upstream direction in the conveyance direction of the hot rolled steel plate by 15 to 60 degrees, and the cooling water jetting nozzles on a most downstream-side row in the conveyance direction of the hot rolled steel plate are inclined in the downstream direction in the conveyance direction of the hot rolled steel plate by 15 to 60 degrees.

(15) A cooling method of a hot rolled steel plate in which a steel plate is cooled with rod-like water flow which is jetted from the cooling equipment for a hot rolled steel plate having any one of the constitutions (1) to (14) at the time of cooling the hot rolled steel plate after hot rolling.

With the use of the cooling equipment for a steel material, a steel material can acquire high thermal transmissivity so that the steel material can speedily reach a target temperature. That is, since the cooling rate can be accelerated, it is possible to develop new products such as a high tensile-strength steel plate, for example. Further, a cooling time of a steel material can be shortened so that the productivity can be enhanced by increasing a manufacturing line speed, for example.

Further, cooling of an upper surface and/or a lower surface of the steel plate can be performed without strip temperature deviation in the steel-plate widthwise direction but and/or uniformly in the steel-plate longitudinal direction from a leading edge to a tailing edge of the steel plate and, hence, a steel plate having high quality can be manufactured. Further, splashing of water to the periphery around the steel plate can be suppressed and, hence, the maintenance property of peripheral equipment can be also enhanced.

DETAILED DESCRIPTION

Hereinafter, one example is explained in conjunction with drawings. The explanation is made by taking a case applying cooling of a steel plate in a steel plate rolling process as an example.

Figure 8:
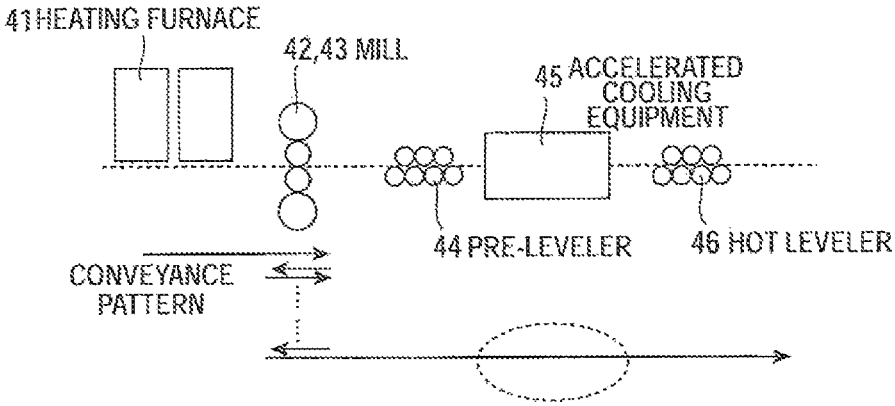
FIG. 8 shows a view explaining the schematic constitution of a steel plate rolling line.

FIG. 8 is a schematic view showing one example of a steel plate rolling line. Rough rolling and finish rolling are applied to a slab taken out from a heating furnace 41 by mills 42, 43, and a thickness of a steel plate formed by such rolling is set to a finish plate thickness at a predetermined finishing temperature. Thereafter, the steel plate is conveyed to accelerated cooling equipment 45 online. To consider a shape of the steel plate after cooling, it is preferable to form the steel plate into a desired shape by a pre-leveler 44 before cooling and, thereafter, to perform accelerated cooling. In the accelerated cooling equipment 45, the steel plate is cooled down to a predetermined temperature by cooling water jetted from upper surface cooling equipment and lower surface cooling equipment. Thereafter, the shape of the steel plate is straightened by a hot leveler 46 when necessary.

First Construction

Figure 1:
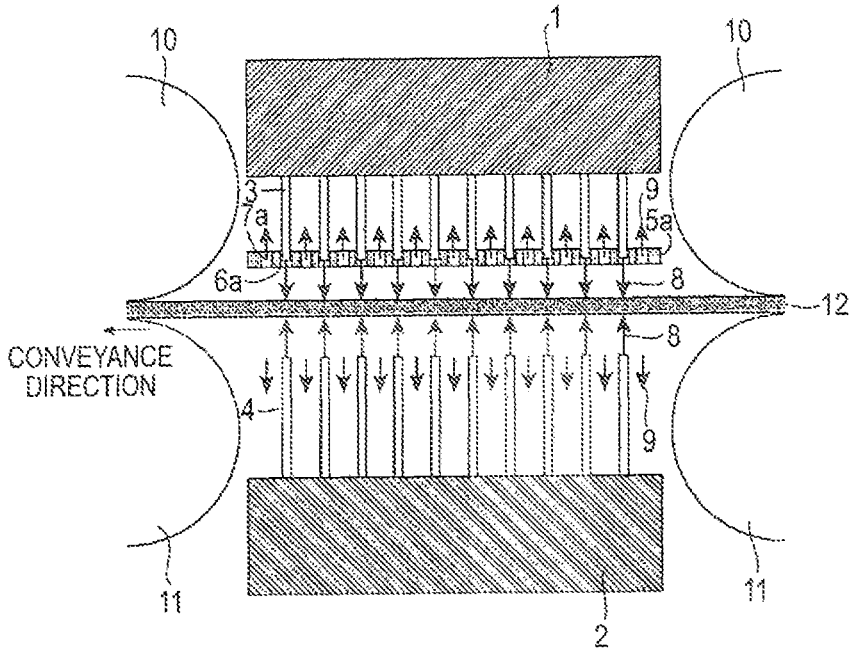
FIG. 1 shows a side view of cooling equipment.

FIG. 1 is a view showing upper and lower surface cooling equipments in a first construction and also is a side view showing the arrangement of cooling nozzles.

(1) Upper Surface Cooling Equipment

The upper surface cooling equipment includes: an upper header 1 which supplies cooling water to an upper surface of a hot rolled steel plate 12; upper cooling water jetting nozzles 3 which are suspended from the upper header 1; and an upper dividing wall 5*a* which is arranged horizontally between the upper header 1 and the hot rolled steel plate 12 while traversing in the steel-plate widthwise direction and has a large number of through-holes (upper water-supply inlets 6*a* and upper drain outlets 7*a*). The upper cooling water jetting nozzle 3 is formed of a circular tube nozzle 3 which jets rod-like water flow, and is arranged such that an end thereof is inserted into the through-hole (upper water-supply inlets 6*a*) formed in the upper dividing wall 5*a* and is positioned above a lower edge portion of the upper dividing wall 5*a*. To prevent a case where the cooling water jetting nozzle 3 is clogged by sucking a foreign substance on a bottom portion of the upper header 1, it is desirable that the cooling water jetting nozzle 3 penetrates the upper header 1 such that an upper end of the cooling water jetting nozzle 3 protrudes into the upper header 1.

The rod-like water flow 8 is cooling water which is jetted from a jetting port of a nozzle having a circular cross-sectional shape (including an elliptical shape and a polygonal shape) of the cooling water jetting nozzle 3 in a pressurized state to some extent, and also is cooling water formed of a water flow having a jetting speed from the nozzle jetting port of 6 m/s or more, and preferably to 8 m/s or more, and having continuity and linearity such that a cross section of the water flow jetted from the nozzle jetting port keeps an approximately circular cross section. That is, the rod-like water flow 8 differs from a free fall flow from a circular tube laminar nozzle and water which is jetted in a liquid droplet state such as sprayed water.

The reason that the end of the circular tube nozzle 3 is inserted into the through-hole and is arranged above the lower edge portion of the upper dividing wall 5*a* is to prevent the circular tube nozzle 3 from being damaged by the upper dividing wall 5*a* even if a steel plate whose leading edge is warped upwardly enters the cooling equipment. Due to such a constitution, the circular tube nozzle 3 can carry out cooling in a favorable state for a long period and, hence, it is possible to prevent the occurrence of strip temperature deviation of the steel plate without carrying out the maintenance of the equipment or the like.

Figure 11:
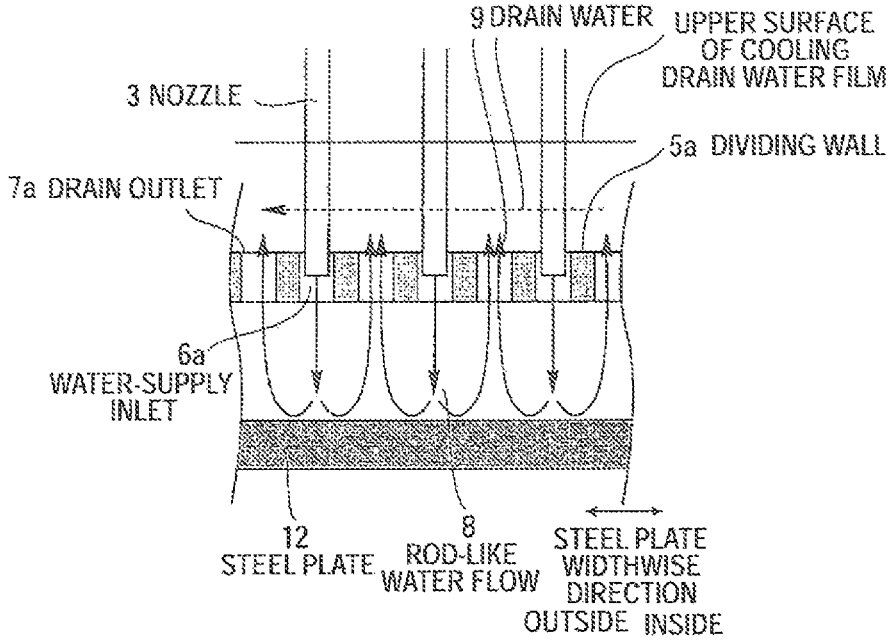
FIG. 11 shows a view explaining the noninterference with cooling drain water on the dividing wall.

Further, the end of the circular tube nozzle 3 is inserted into the through-hole 6*a* and, hence, as shown in FIG. 11, there is no possibility that cooling water jetted from the circular tube nozzle 3 interferes with a widthwise directional flow of drain water indicated by a dotted arrow which flows on an upper surface of the upper dividing wall 5*a*. Accordingly, cooling water jetted from the circular tube nozzle 3 can uniformly reach the upper surface of the steel plate irrespective of the widthwise directional position thereof so that the uniform cooling in the widthwise direction can be performed.

Figure 3:
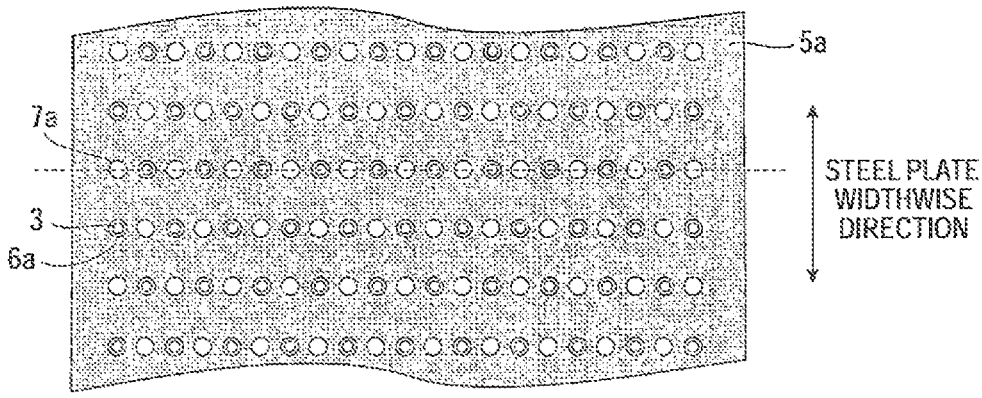
FIG. 3 shows a view that explains an example of a nozzle arrangement on a dividing wall.

To show one example, as shown in FIG. 3, a large number of through-holes having a diameter of 10 mm are formed in the upper dividing wall 5*a* in a check pattern at a pitch of 80 mm in the steel-plate widthwise direction and at a pitch of 80 mm in the conveyance direction. The circular tube nozzle 3 having an outer diameter of 8 mm, an inner diameter of 3 mm and a length of 140 mm is inserted into the upper water-supply inlet 6*a*. The circular tube nozzles 3 are arranged in a staggered grid manner, and the through-holes through which the circular tube nozzles 3 do not penetrate form the upper drain outlets 7*a* for cooling water. In this manner, the large number of through-holes formed in the upper dividing wall 5*a* of the cooling equipment are constituted of the upper water-supply inlets 6*a* and the upper drain outlets 7*a* which are substantially equal in number. Different roles and functions are allocated to the upper water-supply inlets 6*a* and the upper drain outlets 7*a* respectively. To uniformly cool the steel plate, it is preferable to arrange the upper water-supply inlets 6*a* and the upper drain outlets 7*a* at a pitch of 30 mm to 100 mm pitch in the steel-plate widthwise direction as well as in the steel-plate conveyance direction. Accordingly, it is preferable to set the number of the upper water-supply inlet 6*a* and the upper drain outlets 7*a* to 100 pieces to 1100 pieces per 1 $m^2$ of the upper dividing wall 5*a* respectively.

Figure 4:
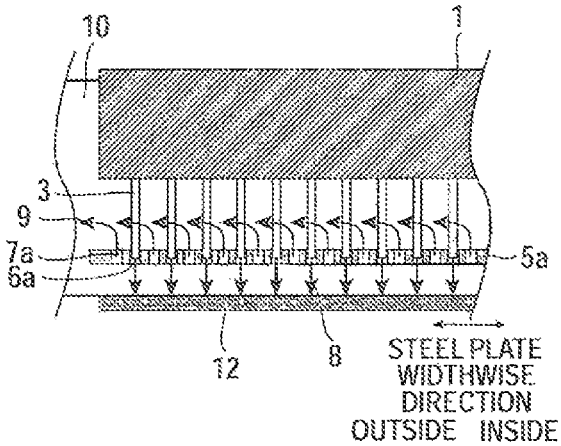
FIG. 4 shows a view explaining the flow of cooling drain water on the dividing wall.

Although described in detail later, a total cross-sectional area of the upper drain outlets 7*a* is sufficiently larger than a total cross-sectional area of inner diameters of the circular tube nozzle 3. That is, the total cross-sectional area of the upper drain outlets 7*a* which approximately 11 times larger than the total cross-sectional area of inner diameters of the circular tube nozzle 3 is assured. Accordingly, as shown in FIG. 1, cooling water which reaches the upper surface of the hot rolled steel plate is filled between the surface of the steel plate and the upper dividing wall 5*a*, is introduced to an area above the upper dividing wall 5*a* (a back surface side of the upper dividing wall 5*a* with respect to the surface of the steel plate) through the upper drain outlets 7*a* and is speedily drained. FIG. 4 is a front view for explaining the flow of cooling drain water in the steel plate widthwise direction on the upper dividing wall 5*a* in the vicinity of an edge portion of the upper dividing wall 5*a*. The drain direction of the upper drain outlets 7*a* is set to the upward direction opposite to the jetting direction of cooling water. Cooling drain water is drained in such a manner that the cooling drain water which passes through the upper dividing wall 5*a* and reach the area above the upper dividing wall 5*a* changes the direction thereof toward the outside in the steel-plate widthwise direction, and flows in a drain passage between the upper header 1 and the upper dividing wall 5*a*.

Figure 5:
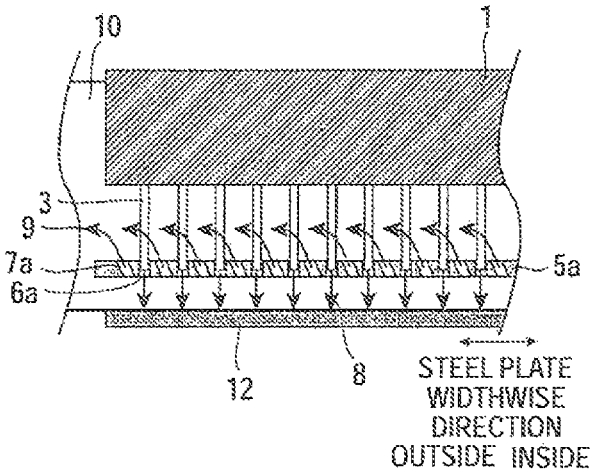
FIG. 5 shows a view explaining another flow of cooling drain water on the dividing wall.

On the other hand, in an example shown in FIG. 5, the upper drain outlets 7*a* are inclined in the steel-plate widthwise direction. That is, the upper drain outlets 7*a* are inclined toward the outside in the widthwise direction such that the drain direction is directed toward the outside in the steel-plate widthwise direction. Due to such a constitution, the flow of the drain water on the upper dividing wall 5*a* in the steel-plate widthwise direction becomes smooth, thus enhancing the draining so that this example is preferable.

Figure 9:
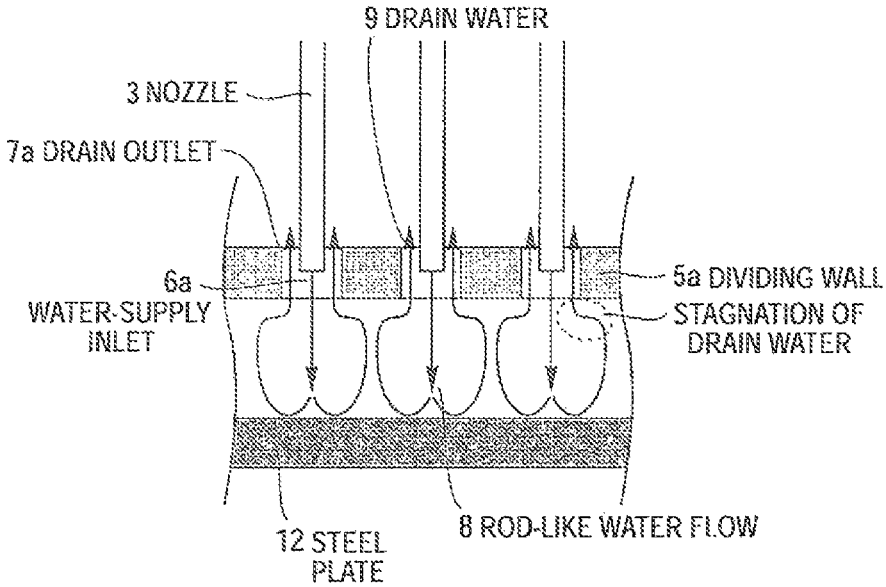
FIG. 9 shows a view explaining the flow of cooling water according to a conventional example.

To consider a case where the upper drain outlet 7*a* and the upper water-supply inlet 6*a* are arranged in the same through-hole as shown in FIG. 9, after impinging on the steel plate, it is difficult for cooling water to pass through to the area above the upper dividing wall 5*a* and, hence, cooling water flows toward an edge portion of the steel plate in the widthwise direction between the steel plate 12 and the upper dividing wall 5*a*. In this case, the closer to the edge portion of the steel plate in the plate width direction, the larger a flow amount of the cooling drain water between the steel plate 12 and the upper dividing wall 5*a* becomes and, hence, the closer to the edge portion of the steel plate in the widthwise direction, the more a force of the jetted water which allows the jetted water to reach the steel plate by penetrating a staying water film is obstructed.

Figure 6:
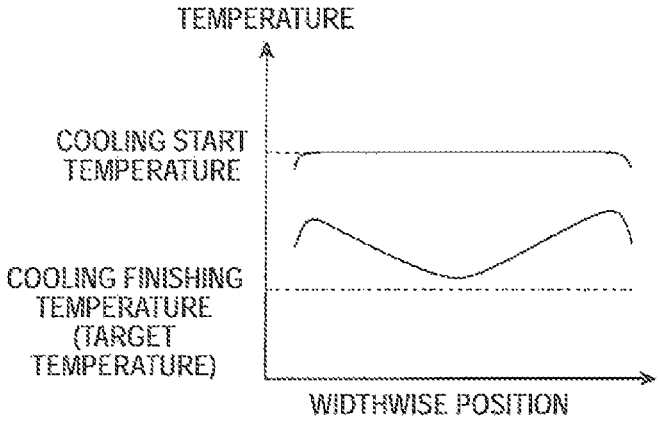
FIG. 6 shows a view explaining the temperature distribution in the widthwise direction of a steel plate according to a conventional example.

In the case of a steel sheet, a plate width is approximately 2 m at maximum and, hence, the influence exerted by the above-mentioned constitution is limited. However, in the case of a steel plate having a plate width of 3 m or more, this influence cannot be ignored. Accordingly, cooling of an edge portion of a steel plate in the widthwise direction becomes weak. In this case, the temperature distribution of the steel plate in the widthwise direction takes the concave non-uniform temperature distribution as shown in FIG. 6.

Figure 7:
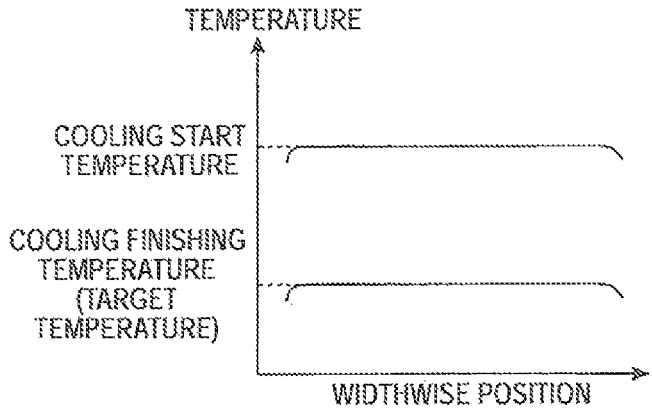
FIG. 7 shows a view explaining the temperature distribution in the widthwise direction of a steel plate.
Figure 10:
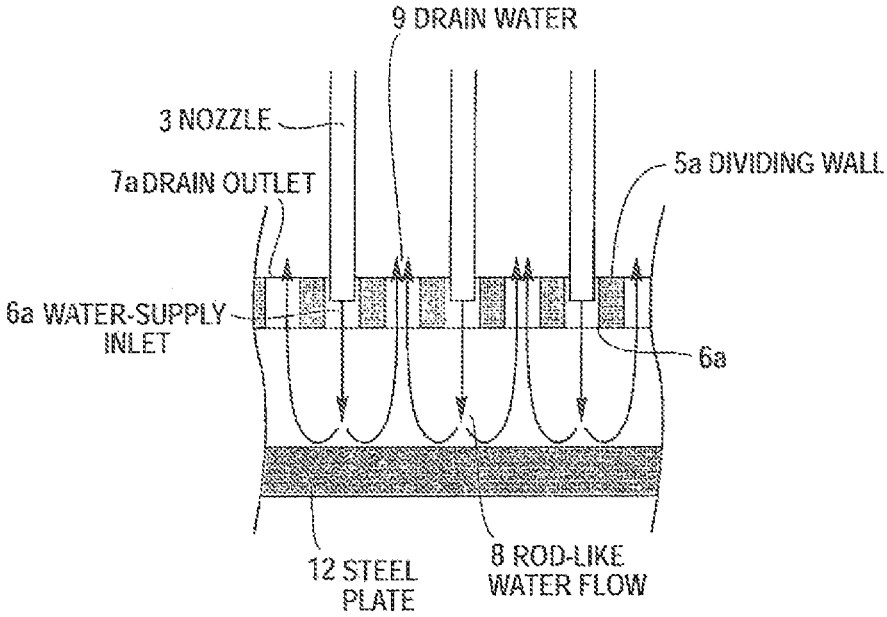
FIG. 10 shows a view explaining the flow of cooling water according to one of our examples.

To the contrary, in the cooling equipment, as shown in FIG. 10, the upper water-supply inlet 6*a* and the upper drain outlet 7*a* are provided separately and their roles are allocated to water supply and water drain respectively and, hence, cooling drain water passes through the upper drain outlets 7*a* formed in the upper dividing wall 5*a* and smoothly flows above the upper dividing wall 5*a*. Accordingly, after cooling the steel plate, the drain water is speedily drained from an upper surface of the steel plate and, hence, cooling water which is supplied succeedingly can easily penetrate a staying water film whereby the cooling equipment can acquire sufficient cooling ability. In this case, the temperature distribution of the steel plate in the widthwise direction can take the uniform temperature distribution in the widthwise direction as shown in FIG. 7.

Hereinafter, the detail of the preferred cooling equipment according to the first construction is explained.

(2) Total Cross-Sectional Area of Upper Drain Outlets 7*a* for Upper Surface Cooling: Not Less than 1.5 Times Total Inner-Diameter Cross-Sectional Area of Circular Tube Nozzles 3

When the total cross-sectional area of the upper drain outlets 7*a* is not less than 1.5 times inner diameters of circular tube nozzle 3, cooling water can be speedily drained. This can be realized, for example, by forming holes each having a size larger than an outer diameter of the circular tube nozzle 3 in the upper dividing wall 5*a* and by setting the number of the upper drain outlet 7*a* equal to or larger than the number of the upper water-supply inlets 6*a*.

When the total cross-sectional area of the upper drain outlets 7*a* is less than 1.5 times the total inner-diameter cross-sectional area of circular tube nozzles 3, the resistance to flow in the upper drain outlet 7*a* is increased so that it is difficult to drain staying water whereby a quantity of cooling water which penetrates a staying water film and reaches a surface of the steel plate is largely decreased thus lowering cooling ability. Accordingly, such setting of the total cross-sectional area of the upper drain outlets 7*a* is not desirable. It is more preferable to set the total cross-sectional area of the upper drain outlets 7*a* not less than four times larger than the total inner-diameter cross-sectional area of the circular tube nozzles 3. On the other hand, when the number of the upper drain outlets 7*a* becomes excessively large or a cross-sectional size of the upper drain outlet 7*a* becomes excessively large, the rigidity of the upper dividing wall 5*a* is decreased so that when a steel plate collides with the upper dividing wall 5*a*, the upper dividing wall 5*a* is easily damaged. Accordingly, it is preferable to set a ratio between the total cross-sectional area of the upper drain outlets 7*a* and the total cross-sectional area of inner diameters of the circular tube nozzles 3 to 1.5 to 20.

(3) Gap Between Outer Peripheral Surface of Circular Tube Nozzle 3 for Upper Surface Cooling and Inner Surface of Upper Water-Supply Inlets 6*a*: Not More Than 3 mm Further, it is desirable to set a gap between an outer peripheral surface of the circular tube nozzle 3 inserted into the upper water-supply inlets 6*a* formed in the upper dividing wall 5*a* and an inner surface of the upper water-supply inlet 6*a* to not more than 3 mm. When this gas is large, due to the influence exerted by an accompanying flow of cooling water jetted from the circular tube nozzle 3, cooling drain water discharged to an upper surface of the upper dividing wall 5*a* is sucked into the gap formed between the inner surface of the upper water-supply inlet 6*a* and the outer peripheral surface of the circular tube nozzle and is supplied to the steel plate again and, hence, cooling efficiency is deteriorated. To prevent such a phenomenon, it is desirable to set the outer diameter of the circular tube nozzle 3 and the size of the upper water-supply inlets 6*a* substantially equal to each other. However, by taking working accuracy and mounting tolerance into consideration, the gap of 3 mm at maximum which does not exert the substantial influence is allowed, and the gap is more preferably set to 2 mm or less.

Further, to enable the cooling water to penetrate the staying water film and reach the steel plate, it is also necessary to optimize the inner diameter and the length of the circular tube nozzle 3, a jetting speed of cooling water and a nozzle distance.

(4) Inner Diameter of Circular Tube Nozzle 3 for Upper Surface Cooling: 3 to 8 mm It is preferable to set the inner diameter of the circular tube nozzle 3 to 3 to 8 mm. When the inner diameter of the circular tube nozzle 3 is less than 3 mm, a water flux jetted from the nozzle becomes narrow so that water energy becomes weak. On the other hand, when the inner diameter of the circular tube nozzle 3 exceeds 8 mm, a flow speed becomes low so that a force which allows the cooling water to penetrate the staying water film becomes weak.

(5) Length of Circular Tube Nozzle 3 for Upper Surface Cooling: 120 to 240 mm It is preferable to set a length of the circular tube nozzle 3 to 120 to 240 mm. The length of the circular tube nozzle 3 implies a length from an inlet port on an upper end of the nozzle 3 which is inserted into the inside of the upper header 1 to some extent to a lower end of the nozzle 3 which is inserted into the upper water-supply inlet 6*a* formed in the upper dividing wall 5*a*. When the length of the circular tube nozzle 3 is shorter than 120 mm, a distance between a lower surface of the upper header 1 and an upper surface of the upper dividing wall 5*a* becomes too short (for example, assuming that a thickness of the upper header 1 is 20 mm, a projection quantity of an upper end of the nozzle 3 in the inside of the upper header is 20 mm, and an insertion quantity of the lower end of the nozzle 3 into the upper dividing wall 5*a* is 10 mm, the distance between the lower surface of the upper header 1 and the upper surface of the upper dividing wall 5*a* becomes less than 70 mm) and, hence, a flow-passage cross-sectional area (a drain space above the dividing wall) in the steel-plate widthwise direction in the space surrounded by the lower surface of the upper header 1 and the upper surface of the upper dividing wall 5*a* becomes small whereby cooling drain water cannot be drained smoothly. On the other hand, when the length of the circular tube nozzle 3 is longer than 240 mm, a pressure loss of the circular tube nozzle becomes large so that a force which allows the cooling water to penetrate a staying water film becomes weak.

(6) Jetting Speed of Cooling Water Jetted from Circular Tube Nozzle 3 for Upper Surface Cooling: 6 m/s or More The jetting speed of cooling water jetted from the circular tube nozzle 3 is 6 m/s or more and, more preferably to 8 m/s or more. When the jetting speed of cooling water is less than 6 m/s, a force which allows the cooling water to penetrate a staying water film becomes extremely weak. The jetting speed of cooling water jetted from the circular tube nozzle 3 is more preferably set to 8 m/s or more since a larger cooling ability can be ensured with such a jetting speed.

(7) Distance from Lower End of Cooling Water Jetting Nozzle (Circular Tube Nozzle) 3 for Upper Surface Cooling to Surface of Steel Plate 12: 30 to 120 mm Further, the distance from the lower end of the cooling water jetting nozzle (circular tube nozzle) 3 for cooling upper surface to the surface of the steel plate 12 is preferably 30 to 120 mm. When the distance is less than 30 mm, the frequency that the steel plate 12 impinges on the upper dividing wall 5*a* is extremely increased so that the maintenance of the equipment becomes difficult. When the distance exceeds 120 mm, a force which allows cooling water to penetrate a staying water film becomes extremely weak.

(8) Draining Roll 10 for Cooling Upper Surface

In cooling the upper surface of the steel plate, to prevent cooling water from spreading in the longitudinal direction of the steel plate, it is preferable to arrange a draining roll 10 in front of and behind the upper header 1. Due to such arrangement, a cooling zone length becomes a fixed value so that a temperature control can be easily performed. The flow of cooling water in the steel plate conveyance direction is stopped by the draining rolls 10 which function as weirs and, hence, cooling drain water flows toward the outside in the steel-plate widthwise direction. However, cooling water is liable to dwell in the vicinity of draining rolls 10.

Figure 2:
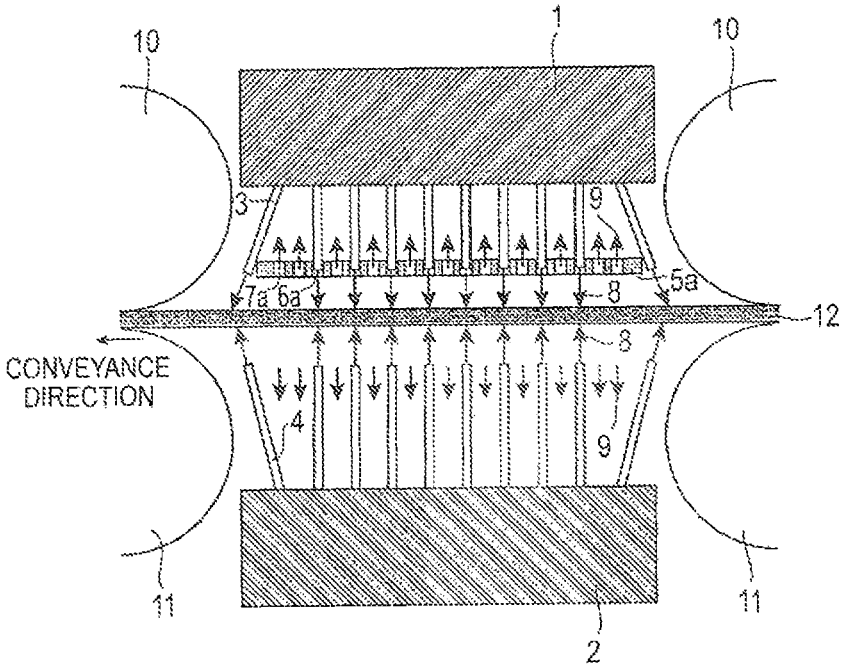
FIG. 2 shows a side view of another cooling equipment.

(9) Inclination Angle of Cooling Water Jetting Nozzle (Circular Tube Nozzle) 3 for Upper Surface Cooling Accordingly, as shown in FIG. 2, among the circular tube nozzles 3 which are arranged in row in the steel plate widthwise direction, the upper cooling water jetting nozzles (circular tube nozzle) 3 on a most upstream-side row in the conveyance direction of the steel plate are preferably inclined in the upstream direction in the conveyance direction of the steel plate by 15 to 60 degrees from the vertical direction, and the upper cooling water jetting nozzles (circular tube nozzles) 3 on a most downstream-side row in the conveyance direction of the steel plate are preferably inclined in the downstream direction in the conveyance direction of the steel plate by 15 to 60 degrees from the vertical direction. Due to such a constitution, it is possible to supply cooling water also to a position in the vicinity of the draining roll 10 and, hence, there is no possibility that cooling water dwells close to the draining roll 10 thus enhancing cooling efficiency. Accordingly, such inclination of the circular tube nozzles 3 is preferable.

In the same manner as the upper cooling water injection nozzles 3, it is also preferable that the lower cooling water jetting nozzles 4 for lower surface cooling on a most upstream-side row in the conveyance direction of the steel plate and on a most downstream-side row in the conveyance direction of the steel plate are inclined in the upstream direction in the conveyance direction of the steel plate by 15 to 60 degrees from the vertical direction and in the downstream direction in the conveyance direction of the steel plate by 15 to 60 degrees from the vertical direction respectively.

The application of the cooling technique is particularly effective when the draining roll 10 is arranged in front of and behind the upper cooling header 1. However, the cooling technique is also applicable to a case where no draining roll is provided. For example, when the upper header 1 is relatively long (when the upper header 1 is approximately 2 to 4 m), the cooling technique is applicable to cooling equipment which prevents leaking of water to a non-water-cooling zone by jetting water spray for purging in front of and behind the upper cooling header 1.

(10) Distance Between Lower Surface of Upper Header 1 for Cooling Upper Surface and Upper Surface of Upper Dividing Wall 5*a*: A Cross-Sectional Area of a Flow Passage in the Steel-Plate Widthwise Direction in a Space Surrounded by the Lower Surface of the Upper Header 1 and the Upper Surface of the Upper Dividing Wall 5*a* Being Not Less than 1.5 Times Total Inner-Diameter Cross-Sectional Area of the Circular Tube Nozzles 3

The distance between the lower surface of the upper header 1 and the upper surface of the upper dividing wall 5*a* is set such that a cross-sectional area of a flow passage in the steel-plate widthwise direction in a space surrounded by the lower surface of the upper header 1 and the upper surface of the upper dividing wall 5*a* is not less than 1.5 times a total inner-diameter cross-sectional area of the circular tube nozzle 3. For example, the distance between the lower surface of the upper header 1 and the upper surface of the upper dividing wall 5*a* is approximately 100 mm or more. When the cross-sectional area of the flow passage in the steel-plate widthwise direction is less than 1.5 times a total inner-diameter cross-sectional area of the circular tube nozzles 3, cooling drain water which is drained from the upper drain outlet 7*a* formed in the upper dividing wall 5*a* cannot be drained smoothly in the steel-plate widthwise direction.

(11) Water Amount Density for Cooling Upper Surface: 1.5 $m^3/(m^2 \cdot min)$ or More A range of water amount density which exhibits an optimum effect is not less than 1.5 $m^3/(m^2 \cdot min)$. When the water amount density is less than 1.5 $m^3/(m^2 \cdot min)$, a thickness of a staying water film on the steel plate does not become so large. Accordingly, there may be a case where even when a known technique which cools a steel plate by a free fall of the rod-like water flow 8 is adopted, the strip temperature deviation in the widthwise direction is not increased remarkably.

On the other hand, even when the water amount density is more than 4.0 $m^3/(m^2 \cdot min)$, the technique is effectively applicable. However, in this case, there arises a drawback in practical use that such water amount density pushes up an equipment cost and, hence, 1.5 to 4.0 $m^3/(m^2 \cdot min)$ is the most practical water amount density.

(12) Lower Surface Cooling Device

In the first construction, the cooling device on a steel-plate lower surface side is not particularly limited. In the construction shown in FIG. 1 and FIG. 2, the example where the cooling header 2 is provided with the circular tube nozzles 4 in the same manner as the upper-surface side cooling device is exemplified. However, in cooling the steel-plate lower surface side, jetted cooling water makes a free fall after impinging on the steel plate and, hence, the dividing wall 5 on the upper surface side cooling which drains cooling drain water in the steel-plate widthwise direction is unnecessary. Further, it may be possible to use a known technique which supplies film-shaped cooling water, atomized spray cooling water or the like.

Second Construction

Next, the second construction is explained.

Another preferred arrangement of the upper water-supply inlets 6*a* and the upper drain outlets 7*a* for more speedily draining cooling water onto the upper dividing wall 5*a* is explained in conjunction with FIG. 21 to FIG. 28. In the drawing, symbol 5*a* indicates the upper dividing wall, symbol 6*a* indicates upper water-supply inlets, symbol 7*a* indicates upper drain outlets, and symbol 3 indicates upper cooling water jetting nozzles (circular tube nozzles) inserted into the upper water-supply inlets 6*a* respectively.

(13) Another Preferred Arrangement of Upper Water-Supply Inlets 6*a* and Upper Drain Outlets 7*a*

Figure 21:
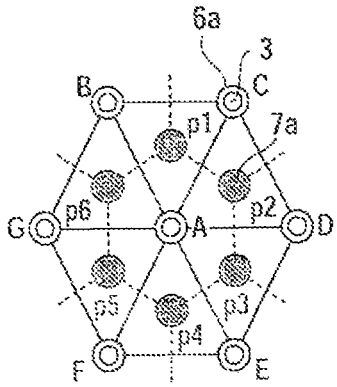
FIG. 21 shows a partial view of the arrangement of water-supply inlets and drain outlets.
Figure 22:
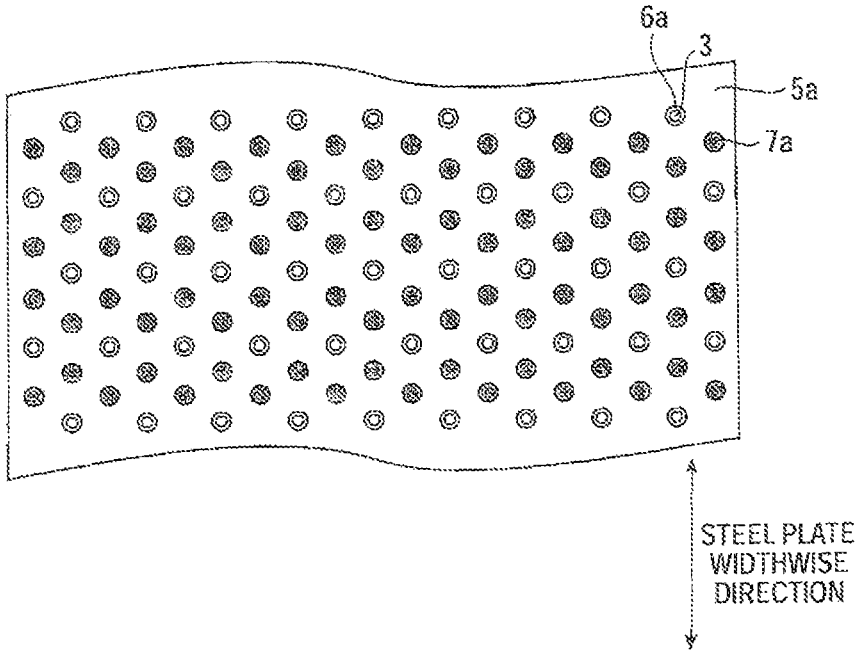
FIG. 22 shows a plan view of a dividing wall obtained by developing FIG. 21.

(a) FIG. 21 and FIG. 22 show one example where the upper water-supply inlets 6*a* are arranged on the upper dividing wall 5*a* in a staggered manner.

FIG. 21 is a partial arrangement view of upper water-supply inlets and upper drain outlets according to the second construction in which the positional relationship between the upper water-supply inlets 6*a* and the upper drain outlets 7*a* when focused on the upper water-supply inlet A is explained. FIG. 22 is a plan view of the dividing wall 5*a* when the partial arrangement of the upper water-supply inlets 6*a* and the upper drain outlets 7*a* shown in FIG. 21 is developed on the dividing wall.

As shown in FIG. 21, the upper water-supply inlets which are arranged adjacent to the upper water-supply inlet A and are arranged in a staggered manner are constituted of six upper water-supply inlets B to G.

On a circumcenter (an intersection where three perpendicular bisectors of respective sides intersect with each other) of a triangle formed of three line segments which connect the upper water-supply inlets B to G arranged adjacent to each other with the upper water-supply inlet A as an apex, one upper drain outlet p1, p2, p3, p4, p5, p6 is provided.

By adopting such arrangement of the upper drain outlets, for example, the upper drain outlet p1 is a point which is equi-distant from the upper water-supply inlets A, B, C, and is also a point where cooling water jetted from the upper water-supply inlets A, B, C impinges on the hot-rolled steel plate 12 and diffuses and merges along a surface of the hot rolled steel plate 12. Since the upper drain outlet p1 is provided at such a merging point, cooling water can be smoothly drained onto the upper dividing wall whereby, as shown in FIG. 10, cooling water surely reaches the surface of the hot-rolled steel plate 12 thus ensuring a high cooling ability. Cooling water exhibits the same cooling ability and drain ability at all positions and, hence, it is possible to acquire the uniform temperature distribution in the steel-plate widthwise direction.

In FIG. 21, the explanation has been made with respect to the case where the triangle ABC is an isosceles triangle where a side AB and a side AC have the same length. However, this construction is not limited to such a triangle. For example, even in the case where the staggered arrangement of the upper water-supply inlets 6*a* is strained so that the positional relationship of the upper water-supply inlets assumes a non-isosceles triangle, the upper drain outlet may be arranged at the circumcenter of the non-isosceles triangle.

Figure 23:
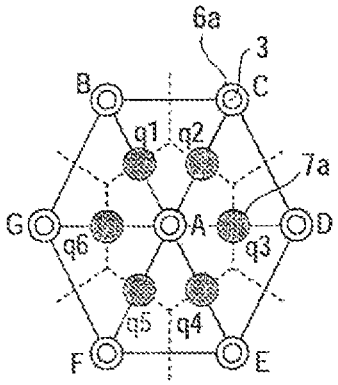
FIG. 23 shows a partial view of another arrangement of the water-supply inlets and the drain outlets.
Figure 24:
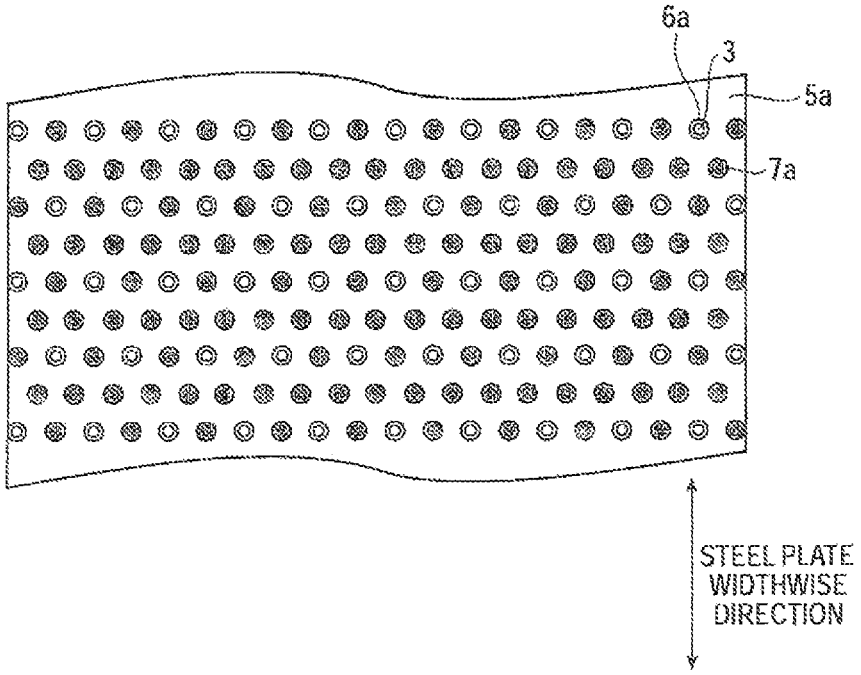
FIG. 24 shows a plan view of a dividing wall obtained by developing FIG. 23.

(b) FIG. 23 and FIG. 24 show another example where the upper water-supply inlets 6*a* are arranged on the upper dividing wall 5*a* in a staggered manner.

FIG. 23 is a partial arrangement view of the upper water-supply inlets and upper drain outlets according to the second construction in which the positional relationship between the upper water-supply inlets and the upper drain outlets 7*a* when focused on the upper water-supply inlet A is explained. FIG. 24 is a plan view of the upper dividing wall 5*a* when the partial arrangement of the upper water-supply inlets 6*a* and the upper drain outlets 7*a* shown in FIG. 23 is developed on the upper dividing wall 5*a*. Although the arrangement of the upper water-supply inlets 6*a* in FIG. 23 is the same as the arrangement of the upper water-supply inlets 6*a* in FIG. 21, the arrangement of the upper drain outlets 7*a* in FIG. 23 differs from the arrangement of the upper drain outlets 7*a* in FIG. 21.

That is, FIG. 23 shows an example in which the upper drain outlets q1 to q6 are respectively arranged at bisection points of respective sides of the triangle formed of three line segments which connect the upper water-supply inlets B to G arranged adjacent to each other with the upper water-supply inlet A as an apex. For example, the upper drain outlet q1 is a point which is equi-distant from the upper water-supply inlets A, B and cooling water jetted from the upper water-supply inlets A, B diffuses and merges along a surface of the hot rolled steel plate 12. Since the drain outlet q1 is provided at such a merging point, cooling water can be smoothly drained onto the upper dividing wall 5*a* whereby, as shown in FIG. 10, cooling water surely reaches the surface of the hot-rolled steel plate 12 thus ensuring a high cooling ability. Cooling water exhibits the same cooling ability and drain ability at all positions and, hence, it is possible to acquire the uniform temperature distribution in the steel-plate widthwise direction.

In FIG. 23, the explanation has been made with respect to the case where the triangle ABC is an isosceles triangle where a side AB and a side AC have the same length. However, this construction is not limited to such a triangle. For example, even in the case where the staggered arrangement of the upper water-supply inlets 6*a* is strained so that the positional relationship of the upper water-supply inlets assumes a non-isosceles triangle, the upper drain outlets may be respectively arranged at a bisection point of each side of the triangle.

Figure 25:
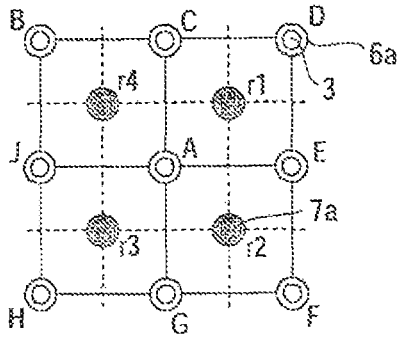
FIG. 25 shows a partial view of another arrangement of water-supply inlets and drain outlets.
Figure 26:
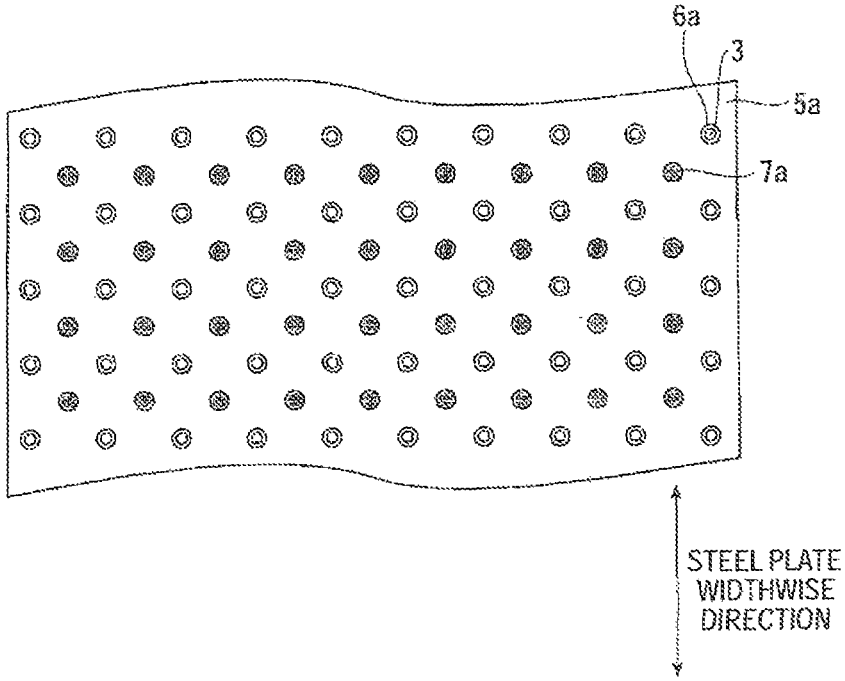
FIG. 26 shows a plan view of a dividing wall obtained by developing FIG. 25.

(c) FIG. 25 and FIG. 26 show an example where the upper water-supply inlets 6*a* are arranged on the upper dividing wall 5*a* in a check pattern.

FIG. 25 is a partial arrangement view of upper water-supply inlets and upper drain outlets according to the second construction in which the positional relationship between the upper water-supply inlets 6*a* and the upper drain outlets 7*a* when focused on the upper water-supply inlet A is explained. FIG. 26 is a plan view of the upper dividing wall 5*a* when the partial arrangement of the upper water-supply inlets and the upper drain outlets shown in FIG. 25 is developed on the upper dividing wall.

As shown in FIG. 25, the upper water-supply inlets which are arranged adjacent to the upper water-supply inlet A and are arranged in a check pattern are constituted of eight upper water-supply inlets B to J. On the center of gravity of a quadrangle (rectangular shape) formed of four line segments which connect the upper water-supply inlets 6 arranged adjacent to each other, one upper drain outlet r1, r2, r3, r4 is provided.

By adopting such arrangement of the upper drain outlets, for example, the upper drain outlet r1 is a point which is equi-distant from the upper water-supply inlets A, C, D, E and is also a point where cooling water jetted from the upper water-supply inlets A, C, D, E impinges on the hot-rolled steel plate 12 and diffuses and merges along a surface of the hot rolled steel plate 12. Since the drain outlet r1 is provided at such a merging point, cooling water can be smoothly drained onto the upper dividing wall 5*a* whereby, as shown in FIG. 10, cooling water surely reaches the surface of the hot-rolled steel plate 12 thus ensuring a high cooling ability. Cooling water exhibits the same cooling ability and drain ability at all positions and, hence, it is possible to acquire the uniform temperature distribution in the steel-plate widthwise direction.

In FIG. 25, the explanation has been made with respect to the case where the quadrangle ACDE is a rectangular shape. However, this construction is not limited to such a rectangular shape. For example, even in the case where the check pattern arrangement of the water-supply inlets 6*a* is strained, as long as the positional relationship of the upper water-supply inlets 6*a* assumes a quadrangle, the upper drain outlets 7*a* may be arranged at the center of gravity of the quadrangle. Since nozzles are generally arranged equidistantly in the widthwise direction, the quadrangle ACDE is taken as at least a parallelogram and the center of gravity is an intersection of two diagonal lines.

Figure 27:
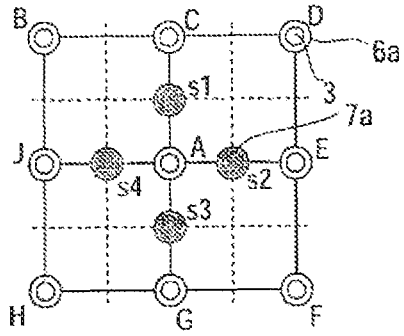
FIG. 27 shows a partial view of another arrangement of water-supply inlets and drain outlets.
Figure 28:
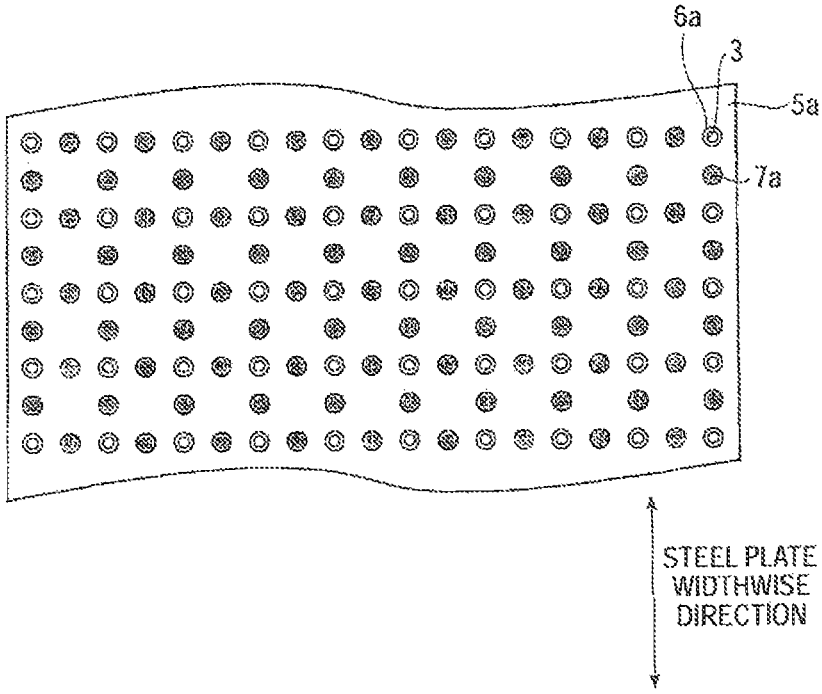
FIG. 28 shows a plan view of a dividing wall obtained by developing FIG. 27.

(d) FIG. 27 and FIG. 28 show another example where the upper water-supply inlets 6*a* are arranged on the upper dividing wall 5*a* in a check pattern.

FIG. 27 is a partial arrangement view of upper water-supply inlets and upper drain outlets according to the second construction in which the positional relationship between the upper water-supply inlets 6*a* and the upper drain outlets 7*a* when focused on the upper water-supply inlet A is explained. FIG. 28 is a plan view of the dividing wall 5*a* when the partial arrangement of the upper water-supply inlets 6*a* and the upper drain outlets 7*a* shown in FIG. 27 is developed on the upper dividing wall.

Although the arrangement of the upper water-supply inlets 6*a* in FIG. 27 is the same as the arrangement of the upper water-supply inlets 6*a* in FIG. 25, the arrangement of the upper drain outlets 7*a* in FIG. 27 differs from the arrangement of the upper drain outlets 7*a* in FIG. 25.

That is, FIG. 27 shows an example in which, on a bisection point of each side of the quadrangle (rectangular shape) formed of four line segments which connect the upper water-supply inlets 6*a* arranged adjacent to each other, one drain outlet s1, s2, s3, s4 is provided. For example, the upper drain outlet s1 is a point which is equi-distant from the upper water-supply inlets A, C and is also a point where cooling water jetted from the upper water-supply inlets A, C diffuses and merges along a surface of the hot rolled steel plate 12.

Since the upper drain outlet s1 is provided at such a merging point, cooling water can be smoothly drained onto the upper dividing wall whereby, as shown in FIG. 10, cooling water surely reaches the surface of the hot-rolled steel plate 12 thus ensuring a high cooling ability. Cooling water exhibits the same cooling ability and drain ability at all positions and, hence, it is possible to acquire the uniform temperature distribution in the steel-plate widthwise direction.

In FIG. 27, the explanation has been made with respect to the case where the quadrangle ACDE is a rectangular shape. However, this construction is not limited to such a rectangular. For example, even in the case where the check pattern arrangement of the water-supply inlets 6*a* is strained, as long as the positional relationship of the upper water-supply inlets 6*a* assumes a quadrangle shape, the upper drain outlets 7*a* may be arranged on a bisection point of each side of the quadrangle.

Whether the relative positional relationship of upper water-supply inlets is regarded as a triangle as in the above-mentioned cases (a), (b) or a quadrangle as in the above-mentioned cases (c), (d) depends on the manner of arrangement of water-supply inlets. When a widest internal angle of a triangle formed by connecting the neighboring upper water-supply inlets is 80° or more, the relative positional relationship of the upper water-supply inlets may be regarded as a quadrangle. For example, an angle A of the triangle ACE in FIG. 25 is 90° and, hence, the relative positional relationship of the upper water-supply inlets is regarded as a triangle ACDE.

The number of upper drain outlets for one upper cooling water jetting nozzle is 2 in the arrangement (a) shown in FIG. 22 and the arrangement (d) shown in FIG. 28, 3 in the arrangement (b) shown in FIGS. 24, and 1 in the arrangement (c) shown in FIG. 26. For example, when an inner diameter of the upper cooling water jetting nozzle 3 is 5 mm and a diameter of the upper drain outlet 7*a* is 10 mm, in all arrangements (a) to (d), a total cross-sectional area of the upper drain outlets 7*a* is four times or more larger than a total inner-diameter cross-sectional area of the circular tube nozzles 3. However, when the inner diameter of the upper cooling water jetting nozzle 3 is 8 mm and the diameter of the drain outlet 7*a* is 12 mm, the total cross-sectional area of the upper drain outlet 7*a* is merely 2.25 times larger than the total cross-sectional area of the inner diameters of the circular tube nozzles 3 and, hence, it is desirable to adopt the construction having the arrangement (a), (b) or (d).

Third Construction

Next, the third construction is explained.

To realize the uniform cooling of the steel plate over the whole length ranging from a leading edge to a tailing edge of the steel plate, or to realize the uniform cooling of the hot-rolled steel plate 12 to be cooled over the whole width even at the widthwise edge portion of the hot-rolled steel plate 12 without being influenced by scattering of jetted cooling water outside the hot-rolled steel plate 12, the preferred lower surface cooling equipment and the preferred arrangement of upper and lower cooling water jetting nozzles described hereinafter may be adopted.

Figure 13:
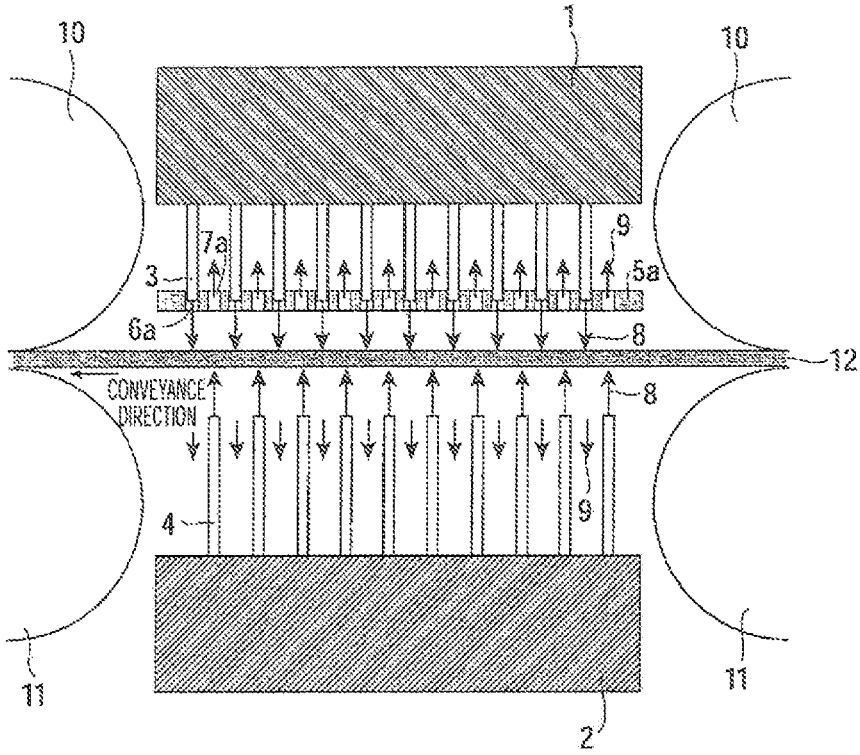
FIG. 13 shows another view explaining an arrangement of cooling equipment.

(14) Lower Surface Cooling Equipment and Arrangement of Upper and Lower Cooling Water Jetting Nozzles The lower surface cooling equipment shown in FIG. 13 includes a lower header 2 which supplies cooling water to a lower surface of the hot-rolled steel plate 12, and lower cooling water jetting nozzles 4 which extend upward in the vertical direction from the lower header 2. The lower cooling water jetting nozzle 4 is formed of a circular tube nozzle 4 which jets rod-like water flow 8.

Figure 14:
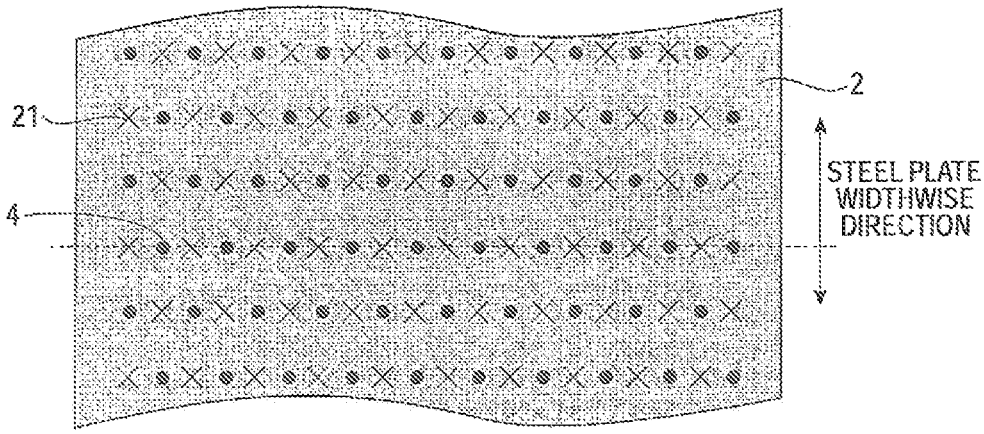
FIG. 14 shows a view explaining the arrangement of nozzles on a lower surface side.

With respect to the arrangement of the upper and lower cooling water jetting nozzles 3, 4 of the cooling equipment shown in FIG. 13 having an upper dividing wall 5*a*, FIG. 3 shows the arrangement of the upper cooling water jetting nozzles 3 and drain outlets 7*a*, and FIG. 14 shows the arrangement of the lower cooling water jetting nozzle 4. Both the upper and lower cooling water jetting nozzles 3, 4 adopt the staggered arrangement. That is, in a state where the hot-rolled steel plate 12 is not present, the upper cooling water jetting nozzles 3 are arranged such that cooling water 8 jetted from the upper cooling water jetting nozzles 3 lands on water landing points 21 on an upper surface of the lower header 2 shown in FIG. 14 so as to prevent the cooling water 8 from intersecting with jetting lines of the lower cooling water jetting nozzle 4.

On the other hand, the lower cooling water jetting nozzles 3, 4 are arranged such that cooling water 8 jetted from the lower cooling water jetting nozzle 4 penetrates drain outlets 7*a* formed in the upper dividing wall 5*a* shown in FIG. 3. Accordingly, cooling water 8 does not intersect with cooling water jetted from the upper cooling water jetting nozzles 3, passes through the drain outlets 7*a* formed in the upper dividing wall 5*a* and enters a space defined between the upper header 1 and the upper dividing wall 5*a*.

Assume that the jetting lines of the upper and lower cooling water jetting nozzles 3, 4 are aligned with each other, in a state where the hot-rolled steel plate 12 to be cooled is not present, both rod-like water flows 8 jetted at a high speed collide with each other and scatter to the surrounding. For example, assume a case where a leading edge of the hot-rolled steel plate 12 advances to a cooling zone where cooling water is jetted from above and below, a water flux of the rod-like water flow 8 which is jetted toward the leading edge portion of the steel plate is collapsed by scattering of cooling waters which are jetted from above and below at directly downstream of the leading edge portion of the steel plate and collide with each other so that cooling ability is changed. Accordingly, it is impossible to uniformly cool the steel plate from leading edge end portion of the steel plate.

Further, a water flux of the rod-like water flow 8 which is jetted toward a steel-plate widthwise edge portion is also collapsed by scattering of jetted cooling water directly outside the steel-plate widthwise edge portion. Further, a water flux of the cooling water 8 which is jetted toward the steel-plate tailing edge portion is collapsed by scattering of jetted cooling water directly upstream of the steel-plate tailing edge portion.

To the contrary, the jetting lines of cooling waters 8 jetted from the upper and lower cooling water jetting nozzles 3, 4 do not intersect with each other and, hence, for example, there is no possibility that cooling waters 8 jetted from above and below at a high speed before the hot-rolled steel plate 12 advances to the cooling zone collide with each other and scatter to the surrounding.

Figure 12:
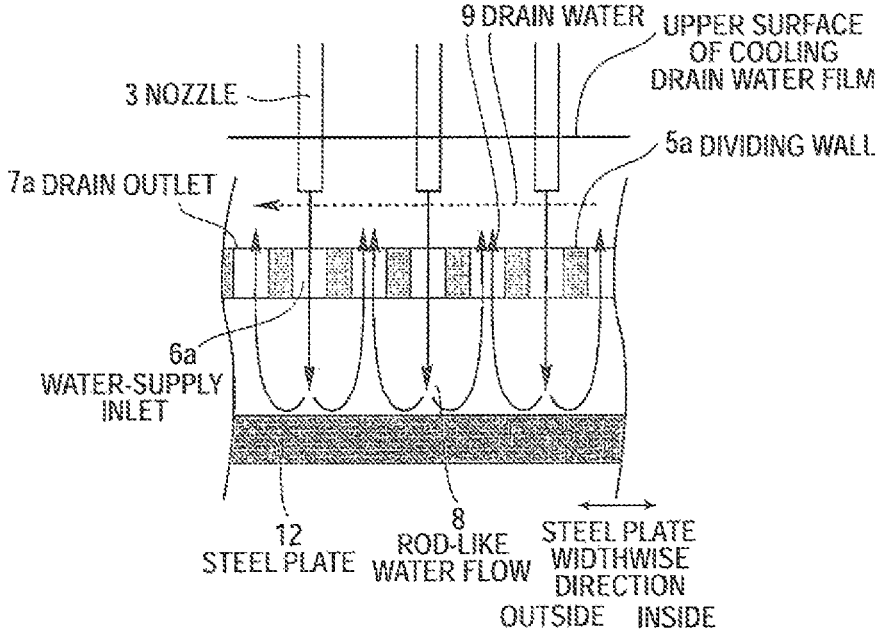
FIG. 12 shows a view explaining the interference with cooling drain water on the dividing wall when ends of nozzle are above the dividing wall.

Further, cooling water 8 jetted from the lower cooling water jetting nozzles 4 is designed to enter the space defined between the upper header 1 and the upper dividing wall 5*a* and, hence, at a point of time that the hot-rolled steel plate 12 advances to the cooling zone, the space defined between the upper header 1 and the upper dividing wall 5*a* is already filled with cooling water whereby after the hot-rolled steel plate 12 advances to the cooling zone, it is possible to speedily bring the hot-rolled steel plate 12 into a stationary state shown in FIG. 12.

Accordingly, it is possible to uniformly cool the steel plate over the whole length ranging from the leading edge to the tailing edge of the steel plate. Further, also the widthwise edge portions of the hot-rolled steel plate 12 to be cooled are not influenced by scattering of the jetted cooling water outside the widthwise edge portion so that it is possible to uniformly cool the hot-rolled steel plate 12 over the whole width.

On the other hand, to allow the lower surface cooling water to reach the hot-rolled steel plate 12, it is necessary to optimize an inner diameter of the circular tube nozzle 4, a jetting speed of cooling water and a nozzle distance.

(15) Inner Diameter of Circular Tube Nozzle 4 for Cooling Lower Surface of Steel Plate: 3 to 8 mm That is, it is preferable to set the inner diameter of circular tube nozzle 4 to 3 to 8 mm in the same manner as cooling of the upper surface of the steel plate. When the inner diameter is less than 3 mm, a water flux jetted from the nozzle becomes narrow so that the water flux is liable to collapse. On the other hand, when the inner diameter of the circular tube nozzle 4 exceeds 8 mm, a flow speed becomes low so that cooling ability is lowered.

(16) Jetting Speed of Cooling Water for Cooling Lower Surface of Steel Plate: 6 m/s or More The jetting speed of cooling water jetted from the circular tube nozzle 4 is 6 m/s or more, and more preferably to 8 m/s or more. When the jetting speed of cooling water is less than 6 m/s, energy of cooling water when the cooling water impinges on the lower surface of the steel plate is weak so that water hardly spreads along the lower surface of the steel plate whereby cooling ability of the cooling water is lowered. When the jetting speed of cooling water is 8 m/s or more, the cooling water can ensure the larger cooling ability. Accordingly, such jetting speed is preferable.

(17) Distance from Upper End of Lower Cooling Water Jetting Nozzle 4 for Cooling Lower Surface of steel plate 12 to lower surface of steel plate 12: 30 to 180 mm Further, it is preferable that the distance from the upper end of the lower cooling water jetting nozzle 4 for cooling the lower surface of the steel plate 12 to the lower surface of the steel plate 12 is 30 to 180 mm. When the distance is less than 30 mm, frequency that the hot-rolled steel plate 12 collides with the circular tube nozzle 4 is extremely increased so that the maintenance of the equipment becomes difficult. When the distance exceeds 180 mm, probability that cooling water which falls after impingement with the hot-rolled steel plate 12 collapses a water flux of cooling water newly jetted becomes high.

(18) Water Amount Density for Cooling Lower Surface of Steel Plate: 2.0 to 6.0 $m^3/(m^2 \cdot min)$ In this construction where the lower surface cooling water which impinges on the steel plate directly falls, it is desirable to set water amount density for lower surface cooling to a value approximately 1.3 to 2.0 times larger than water amount density for upper surface cooling. A range of the water amount density for lower surface cooling is 2.0 to 6.0 $m^3/(m^2 \cdot min)$. Although the water amount density for lower surface cooling is higher than the water amount density for upper surface cooling, such water amount density can be realized by increasing an inner diameter of the nozzle, by increasing the number of nozzles or by increasing injection pressure.

When the water amount density is lower than 2.0 $m^3/(m^2 \cdot min)$, lower surface cooling becomes weaker than upper surface cooling and, hence, upward warping occurs during cooling. Although the application of our technique is effective even in a case where the water amount density is higher than 6.0 $m^3/(m^2 \cdot min)$, the application of our technique gives rise to a drawback on practical use such as the increase of an equipment cost and, hence, the most practical water amount density is 2.0 to 6.0 $m^3/(m^2 \cdot min)$.

Fourth Construction

Next, the fourth construction is explained.

Figure 15:
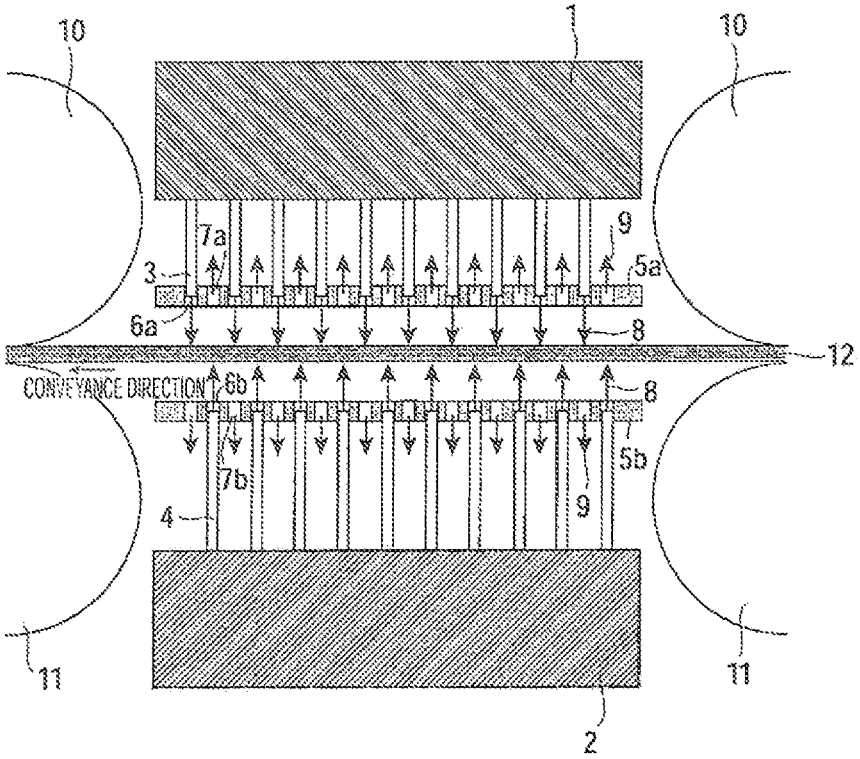
FIG. 15 shows yet another view explaining the arrangement of cooling equipment.

FIG. 15 is a side view showing the arrangement of upper and lower surface cooling equipments according to the fourth construction. Except for matters relating to a lower dividing wall 5*b* explained hereinafter, the fourth construction is basically equal to the third construction and, hence, identical parts are given same symbols and their explanation is omitted.

(19) Lower Surface Cooling Device

The lower dividing wall 5*b* may be provided also for lower-surface-side cooling of the hot-rolled steel plate. Lower surface cooling equipment shown in FIG. 15 includes a lower header 2 which supplies cooling water to a lower surface of the hot rolled steel plate 12, lower cooling water jetting nozzles 4 which extend upward vertically from the lower header 2, and the lower dividing wall 5*b* which is arranged horizontally between the lower header 2 and the hot-rolled steel plate 12 over the steel plate widthwise direction and has a large number of through holes (water-supply inlets 6*b* and drain-outlets 7*b*). The lower cooling water jetting nozzle 4 is formed of a circular tube nozzle 4 which jets rod-like water flow, and is arranged such that an end thereof is inserted into the through-hole (water-supply inlet 6*b*) formed in the lower dividing wall 5*b* and is arranged below an upper end portion of the lower dividing wall 5*b*.

The reason the end of circular tube nozzle 4 is inserted into the through hole and is arranged below the upper end portion of the lower dividing wall 5*b* is that even when the hot-rolled steel plate 12 whose leading edge is warped downward enters the cooling equipment, it is possible to prevent the circular tube nozzle 4 from being damaged by the lower dividing wall 5*b*.

Figure 17:
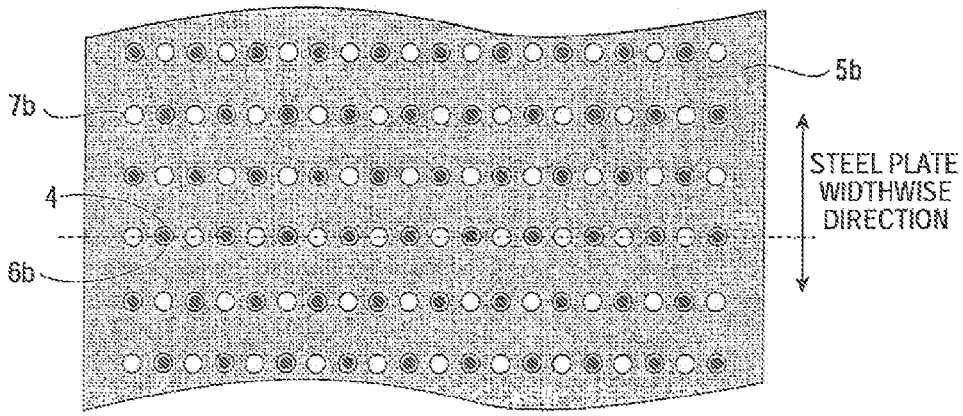
FIG. 17 shows a view explaining the arrangement of nozzles on a lower surface side.

To show one example in FIG. 17, a large number of through-holes each having a diameter of 10 mm are formed in the lower dividing wall 5*b* in a check pattern. The circular tube nozzle 4 having an outer diameter of 8 mm and an inner diameter of 3 mm is inserted into the water-supply inlet 6*b*. The circular tube nozzles 4 are arranged in a staggered grid manner. The through-holes through which the circular tube nozzles 4 do not penetrate form the drain outlets 7*b* for cooling water. Cooling drain water produced after cooling the lower surface of the steel plate makes a free fall and is drained from the drain outlets 7*b*. In this manner, the large number of through-holes formed in the lower dividing wall 5*b* of the cooling equipment are constituted of the water-supply inlets 6*b* and the drain outlets 7*b* which are substantially equal in number. Different roles and functions are allocated to the water-supply inlets 6*b* and the drain outlets 7*b*.

When the lower dividing wall 5*b* is not provided, portions of the steel plate where rod-like water flow impinges on the lower surface of the steel plate are cooled. To the contrary, when the lower dividing wall 5*b* is provided, a space defined between an upper surface of the lower dividing wall 5*b* and a lower surface of the steel plate is filled with cooling water and cooling by stirring is performed so that water cooling is performed in the whole region of the lower surface of the steel plate. That is, point cooling is changed to face cooling.

Further, since the space is extremely narrow, time necessary for filling the space with cooling water after the leading edge of the steel plate enters the cooling equipment is extremely short whereby the strip temperature deviation in the steel-plate longitudinal direction hardly occurs.

It is preferable to set a distance between the lower dividing wall 5*b* and the hot-rolled steel plate 12 to 30 to 120 mm for acquiring a stirring cooling effect. When the distance is less than 30 mm, frequency that the hot-rolled steel plate 12 collides with the dividing wall 5*b* is extremely increased so that the maintenance of the equipment becomes difficult. When the distance exceeds 120 mm, a force which allows cooling water to penetrate a film of filled water and to reach the lower surface of the steel plate becomes extremely weak, and it also takes considerable time to fill the space with cooling water so that strip temperature deviation in the steel plate longitudinal direction is liable to occur.

(20) Arrangement of Upper and Lower Cooling Water Jetting Nozzles.

Figure 16:
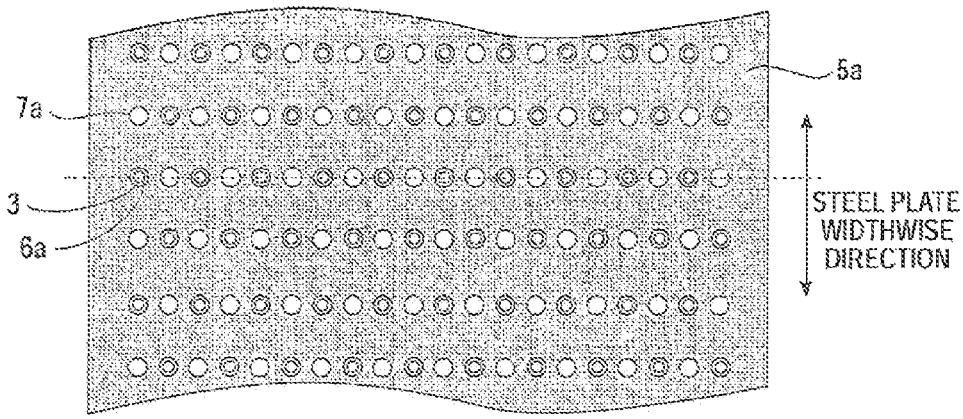
FIG. 16 shows a view explaining the arrangement of nozzles on an upper surface side.

With respect to the arrangement of the upper and lower cooling water jetting nozzles 3, 4 of the cooling equipment shown in FIG. 15 having dividing walls 5*a*, 5*b* above and below the steel plate 12, FIG. 16 shows the arrangement of the upper cooling water jetting nozzles 3 and drain outlets 7*a*, and FIG. 17 shows the arrangement of the lower cooling water jetting nozzles 4 and the drain outlets 7*b*. Both the upper and lower cooling water jetting nozzles 3, 4 adopt the staggered arrangement. That is, in a state where the hot-rolled steel plate 12 is not present, cooling water jetted from the upper cooling water jetting nozzles 3 penetrates the drain outlets 7*b* formed in the lower dividing wall 5*b* in a staggered manner as shown in FIG. 17, and does not intersect with cooling water jetted from the lower cooling water jetting nozzles 4 and enters the space defined between the lower header 2 and the lower dividing wall 5*b* after passing the drain outlets 7*b* formed in the lower dividing wall 5*b*.

On the other hand, cooling water jetted from the lower cooling water jetting nozzles 4 is designed to penetrate the drain outlets 7*a* shown in FIG. 16 such that cooling water does not intersect with cooling water jetted from the upper cooling water jetting nozzles 3, passes through the drain outlets 7*a* formed in the upper dividing wall 5*a* and enters a space defined between the upper header 1 and the upper dividing wall 5*a*. Due to such arrangement, the jetting lines of the upper and lower cooling water jetting nozzles 3, 4 do not intersect with each other.

In this manner, the jetting lines of cooling waters 8 jetted from the upper and lower headers 1, 2 do not intersect with each other and, hence, in the same manner as the third construction, there is no possibility that cooling waters which are jetted from above and below the hot-rolled steel plate 12 at a high speed before the hot-rolled steel plate 12 enters a cooling zone collide with each other thus scattering to the surrounding and, hence, the cooling equipment can ensure uniform and high cooling ability in the cooling zone over the whole length of the steel plate from a leading edge to a tailing edge of the steel plate.

(21) Other Constitutions

In this construction (fourth construction), with respect to the cooling equipment on an upper surface side, an inner diameter of the circular tube nozzle 3, a jetting speed of cooling water, a nozzle distance, water amount density and the like may be set in the same manner as the third construction.

On the other hand, with respect to this construction provided with the lower dividing wall 5*b*, cooling water is filled in the space defined between the upper surface of the lower dividing wall 5*b* and the lower surface of the steel plate so that the substantially same cooling is obtained on the lower surface side as the cooling on the upper surface side and, hence, a water amount density for cooling the lower surface of the steel plate may be set substantially equal to the water amount density for cooling the upper surface of the steel plate. It is preferable to set the water amount density to 1.5 to 4.0 $m^3/(m^2 \cdot min)$. Further, the jetting speed of cooling water from the lower cooling water jetting nozzle (circular tube nozzle) 4 is, for allowing the cooling water to penetrate a film of filled water, set to 6 m/s or more, and more preferably to 8 m/s or more. The inner diameter of the circular tube nozzle 4 may be set to 3 to 8 mm in the same manner as the upper surface cooling.

Fifth Construction

Next, the fifth construction is explained.

Figure 18:
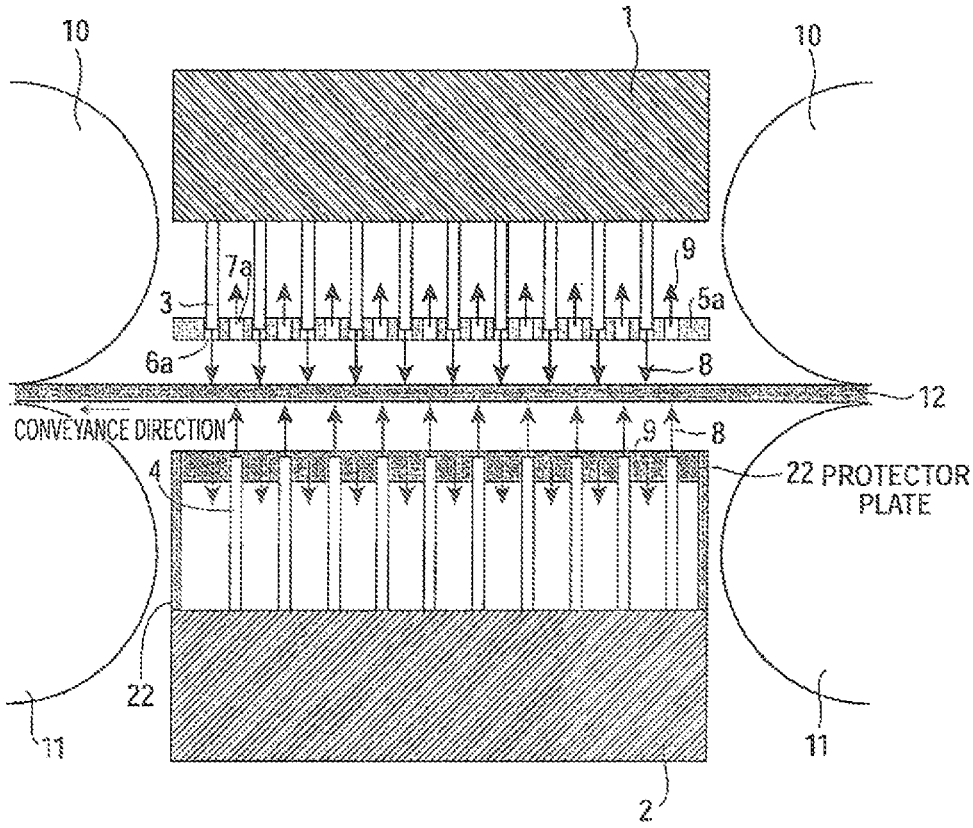
FIG. 18 shows a further view explaining an arrangement of cooling equipment.

FIG. 18 is a view showing upper and lower surface cooling equipments according to the fifth construction, and also is a side view showing the arrangement of cooling equipment. Except for matters relating to a protector plate explained hereinafter, the fifth construction is substantially equal to the third construction and, hence, identical parts are given same symbols and their explanation is omitted.

Figure 20:
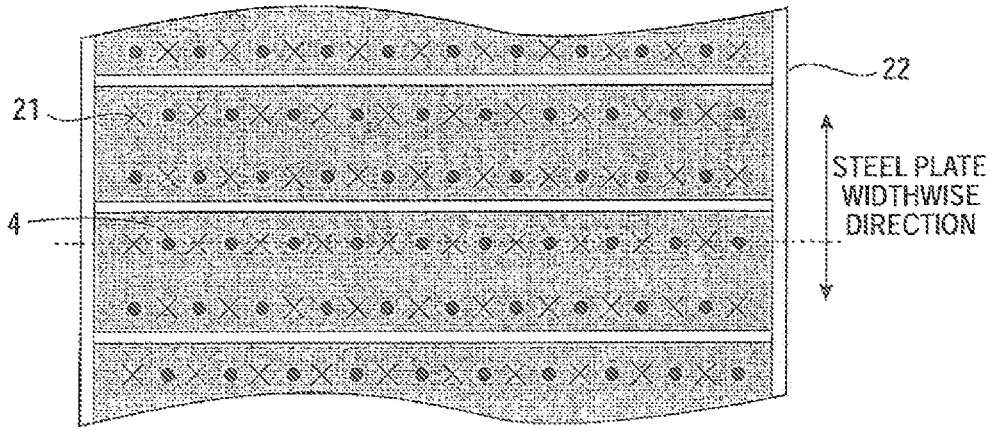
FIG. 20 shows a view explaining the arrangement of nozzles on a lower surface side.

When a dividing wall is not arranged in cooling the lower surface of the steel plate, it is preferable to arrange protector plates 22 for protecting lower cooling water jetting nozzles 4. As shown in FIG. 18 and FIG. 20, the protector plates 22 may preferably be arranged in such a manner that the protector plates 22 surround the lower cooling jetting nozzles 4 at both ends in the longitudinal direction of the steel plate while avoiding the lower cooling water jetting nozzles 4 and water landing points 21 of upper surface cooling water and are arranged at a fixed pitch in the widthwise direction of the steel plate by taking strength of the protector plates in the widthwise direction of the steel plate into consideration.

By positioning upper ends of the protector plate 22 10 mm or more higher than end portions of the lower cooling water jetting nozzles 4 and 20 mm or more lower than an upper end of a table roll, even when a hot-rolled steel plate 12 enters a cooling zone, the hot-rolled steel plate 12 hardly collides with the lower cooling water jetting nozzles 4 and the protector plates 22.

Even when a hot-rolled steel plate 12 which is warped downward enters the cooling zone by any chance, the hot-rolled steel plate 12 merely hits the protector plate 22 so that it is possible to prevent the lower cooling water jetting nozzles 4 from being damaged. By arranging the protector plates at a widthwise pitch of 100 to 300 mm, there is no possibility that the hot-rolled steel plate 12 hits the lower cooling water jetting nozzles 4. FIG. 20 shows an example where the protector plates 22 are assembled into a ladder shape so that a region which surrounds nozzles is formed into a rectangular shape. However, the region which surrounds the nozzles may be formed into a parallelogram.

Further, also in this case, in the same manner as the cooling equipment shown in FIG. 13, jetting lines of the upper and lower cooling water jetting nozzles 3, 4 do not intersect with each other.

In the fifth construction, inner diameters of the circular tube nozzle 3, 4, a jetting speed of cooling water, a nozzle distance, water amount density and the like in the cooling equipment on an upper surface side and the cooling equipment on a lower surface side of the steel plate may be set in the same manner as the third construction.

EXAMPLE 1

As an example of the first construction, the explanation is made with respect to a case where cooling of a steel plate with a tensile strength of 590 Mpa class in a steel plate rolling process is performed in conjunction with drawings.

In the steel plate rolling equipment schematically shown in FIG. 8, forming rolling and broad side rolling are applied to a slab taken out from the heating furnace 41 by mills 42, 43 and, thereafter, rough rolling is applied to the slab to form a steel plate. Then, finish rolling is applied to the steel plate so that the steel plate has a plate thickness of 25 mm and a plate width of 4.5 m. A steel plate surface temperature measured immediately after finish rolling, that is, a finishing temperature is 820° C. Thereafter, the steel plate is made to pass through the pre-leveler 44, and accelerated cooling is applied to the steel plate in the accelerated cooling equipment 45. Cooling is conducted from a cooling start temperature of 780° C. to a cooling finishing temperature (a value obtained by measuring temperature after heat is restored at an exit side of the accelerated cooling equipment) 560° C.

The upper surface cooling equipment described in the above-mentioned construction is used. This cooling equipment is equipment where cooling water supplied to the upper surface of the steel plate is made to flow above the dividing wall 5*a* as shown in FIG. 1, and is provided with a flow passage which allows cooling water to be drained from a side in the steel plate widthwise direction as shown in FIG. 4.

Holes each having a diameter of 12 mm are formed in the dividing wall 5*a* in a check pattern and, as shown in FIG. 3, the circular tube nozzles are inserted into the water supply inlets arranged in a staggered grid pattern, and remaining holes are used as drain outlets. Further, as shown in FIG. 2, the cooling water jetting nozzles on a most upstream-side row in the conveyance direction of the steel plate are inclined in the upstream direction in the conveyance direction of the steel plate by 30 degrees, and the cooling water jetting nozzles on a most downstream-side row in the conveyance direction of the steel plate are inclined in the downstream direction in the conveyance direction of the steel plate by 30 degrees, thus supplying cooling water also to positions close to the draining rolls 10. A distance between a lower surface of the header 1 and an upper surface of the dividing wall 5*a* is set to 100 mm.

Each nozzle 3 has an inner diameter of 5 mm, an outer diameter of 9 mm and a length of 170 mm, and upper ends of the nozzles 3 are projected into the header 1. Further, a jetting speed of rod-like water flow 8 is set to 8.9 m/s. A pitch of the nozzles 3 in the steel plate widthwise direction is set to 50 mm, and the nozzles are arranged in 10 rows in the longitudinal direction in a zone having an inter-table-roller distance of 1 m. Water amount density of the upper cooling water jetting nozzles 3 is 2.1 $m^3/(m^2 \cdot min)$. A lower end of the nozzle 3 for upper surface cooling is arranged to assume an intermediate position between the upper and lower surfaces of the dividing wall 5*a* having a plate thickness of 25 mm, and a distance to the surface of the steel plate from the lower end of the nozzle 3 is set to 80 mm.

The lower surface cooling equipment, except for that the lower surface cooling equipment does not have the dividing wall 5*a*, uses the substantially same cooling equipment as the upper surface cooling equipment as shown in FIG. 1, and the jetting speed of the rod-like water flow 8 from the lower cooling water jetting nozzle 4 and the water amount density of lower cooling water jetting nozzle 4 are set 1.5 times the jetting speed and the water amount density of the nozzles 3 for upper surface cooling.

In the upper surface cooling equipment of the example 1, a total cross-sectional area of the drain outlets is sufficiently larger, that is, approximately six times larger than a total cross-sectional area of inner diameters of the nozzles and, hence, the jetted cooling water which impinges on the steel plate flows upward and is speedily drained. Further, a flow-passage cross-sectional area of a space defined between the lower surface of the header 1 and the upper surface of the dividing wall 5*a* at both outer sides in the steel-plate widthwise direction is sufficiently wide, that is, approximately 5 times wider than the total cross-sectional area of inner diameters of the nozzles 3 and, hence, draining of cooling water from the plate edge portions is also extremely smooth. Since drain cooling water is speedily drained after cooling the steel plate, cooling water supplied in a successive manner can easily penetrate a staying water film whereby the cooling equipment can acquire cooling ability higher than cooling ability of conventional cooling equipment.

Cooling time necessary for decreasing a cooling stop temperature at the center of the steel plate in the plate widthwise direction to 560° C. can be reduced to 2.5 seconds. Accordingly, the cooling rate is increased and, hence, an alloy content of steel necessary for obtaining high strength (for example, Mn or the like) can be reduced thus realizing the reduction of a manufacturing cost.

The temperature distribution in the steel plate widthwise direction is 550 to 560° C., thus exhibiting the approximately uniform distribution as shown in FIG. 7 where the strip temperature deviation in the steel plate widthwise direction becomes small, that is, 10° C. Accordingly, the acceptance rate of a material test is high, that is, 99.5% so that a yield is also high.

The lower end of the nozzle 3 is set at the intermediate position between the upper and lower ends of the dividing wall 5*a* and, hence, even when the steel plate whose upward warping caused by the pre-leveler 44 cannot be straightened or the steel plate on which upward warping occurs during cooling collides with the dividing wall 5*a*, the dividing wall 5*a* plays a role of a protector plate so that there is no breaking of the nozzle 3.

To the contrary, as a Comparison Example 1, cooling equipment described in Japanese Patent Unexamined Publication 2004-66308 is used. In that cooling equipment, slit-shaped holes are formed in a dividing wall. Conditions other than a shape of holes formed in the dividing wall are set equal to the conditions used in the above-mentioned Example 1. In the cooling equipment of the Comparison Example 1, as shown in FIG. 9, after impinging on the steel plate, it is difficult for cooling water to escape upward and, hence, water cooling time of 3 seconds is necessary for decreasing a cooling stop temperature at the center of the steel plate in the plate widthwise direction to 560° C.

The plate widthwise distribution of the cooling stop temperature forms a concave shape as shown in FIG. 6. The highest temperature in the vicinity of the plate edge portion is 600° C., and the strip temperature deviation (maximum temperature—minimum temperature) in the widthwise direction is 40° C. A part of the product is taken out and is subject to a material test. A result of the test shows that the acceptance rate is low, that is, 70% and a yield is also bad.

Further, although holes are formed in the dividing wall in a slit shape, the rigidity of such portions are weak so that when the upwardly warped steel plate collides with the dividing wall, the dividing wall and the nozzle are deformed and broken.

EXAMPLE 2

As another Example 2 of the first construction, the explanation is made with respect to a case where the following cooling conditions are changed in a steel plate rolling process substantially equal to the steel plate rolling process of the first Example 1.

In the cooling equipment used in Example 2, with respect to the upper surface cooling equipment substantially equal to the upper surface cooling equipment of Example 1 shown in FIG. 1, holes each having a diameter of 11 mm and holes each having a diameter of 14 mm are formed in the dividing wall 5*a* alternately in a check pattern. As shown in FIG. 3, the holes each having a diameter of 14 mm which are arranged in a staggered grid pattern are used as water supply inlets 6*a* and circular tube nozzles 3 are inserted into the water supply inlets 6*a*, and the remaining holes each having a diameter of 11 mm are used as drain outlets 7*a*. A distance between the lower surface of the header 1 and the upper surface of the dividing wall 5*a* is set to 100 mm.

The nozzles 3 each of which has an inner diameter of 8 mm, an outer diameter of 11 mm and a length of 170 mm, and upper ends of the nozzles 3 are projected into the header 1. Further, a jetting speed of rod-like water flow 8 is set to 6.3 m/s. Water amount density of the upper cooling jetting nozzles 3 is 3.8 $m^3/(m^2 \cdot min)$. A lower end of the nozzle for upper surface cooling is arranged to assume an intermediate position between the upper and lower surfaces of the dividing wall having a plate thickness of 30 mm, and a distance to the surface of the steel plate from the lower end of the nozzle is set to 50 mm. Conditions other than the above-mentioned conditions are set substantially equal to the corresponding conditions in Example 1.

The lower surface cooling equipment, except for that the lower surface cooling equipment does not have the lower dividing wall 5*b* shown in FIG. 1, uses the substantially same cooling equipment as the upper surface cooling equipment, a distance from an end of the lower cooling water jetting nozzle 4 to a surface of the steel plate is set to 80 mm. Further, the jetting speed of the rod-like water flow 8 and the water amount density are set 1.5 times the jetting speed and the water amount density of the upper cooling water jetting nozzle 3.

In the upper surface cooling equipment of Example 2, a total cross-sectional area of the drain outlets 7*a* is sufficiently large, that is, approximately 2 times larger than a total cross-sectional area of inner diameters of the nozzles 3 and, hence, the jetted cooling water which impinges on the steel plate flows upward and is speedily drained. Further, a flow-passage cross-sectional area of a space defined between the lower surface of the header 1 and the upper surface of the dividing wall 5*a* at both outer sides in the steel-plate widthwise direction is sufficiently wide, that is, approximately 2 times wider than the total cross-sectional area of inner diameters of the nozzles and, hence, draining of cooling water from the plate edge portions is also extremely smooth.

Cooling time necessary for decreasing a cooling stop temperature at the center of the steel plate in the plate widthwise direction to 560° C. can be reduced to 2.0 seconds. The temperature distribution in the steel plate widthwise direction assumes the substantially uniform distribution shown in FIG. 7 at a temperature of 550 to 560° C. so that the uniform cooling can be realized at a high cooling rate in the same manner as Example 1.

EXAMPLE 3

As an example of the second construction, the explanation is made with respect to a case where cooling of a steel plate having a tensile stress of 590 MPa class is performed in a steel plate rolling process in conjunction with drawings.

With respect to steel plate rolling conditions, except for the cooling equipment described hereinafter, the all conditions used in this example are equal to the corresponding conditions used in Example 1.

In the cooling equipment used in an accelerated cooling test, the cooling equipment shown in FIG. 1 which has the upper dividing wall 5*a* is provided on a steel plate upper surface side, and the cooling equipment has the same structure as Example 1 on a steel plate lower surface side.

In this example, with respect to the arrangement of the upper water-supply inlets 6*a* and the upper drain outlets 7*a* formed in the dividing wall 5*a* formed on the upper surface side of the steel plate, two kinds of tests are carried out. That is, Example 3 is a case where, as shown in FIG. 21, the upper water-supply inlets 6*a* are arranged in a staggered pattern, the upper drain outlet 7*a* is provided at a circumcenter of a triangle formed of three line segments which connect the neighboring upper water-supply inlets 6*a* to each other, and six upper drain outlets 7*a* are arranged on vertices of a hexagon around one upper water-supply inlet 6*a*.

Example 4 is a case where, as shown in FIG. 25, the upper water-supply inlets 6*a* are arranged in a check pattern, the upper drain outlet 7*a* is provided at the center of gravity of a quadrangle formed of four line segments which connect the neighboring upper water-supply inlets 6*a* to each other, and four upper drain outlets 7*a* are arranged on vertices of the quadrangle around one upper water-supply inlet 6*a*. In accordance with the patterns shown in FIG. 21 and FIG. 25, through holes each having a diameter of 12 mm are formed in the upper dividing wall 5*a*, ends of circular tube nozzles 3 are inserted into the upper water-supply inlets 6*a*, and the remaining holes are used as the upper drain outlets.

A size of the circular tube nozzle 3 in use is set such that the inner diameter is 5 mm, the outer diameter is 9 mm, and the pitch of the nozzles 3 in the steel plate widthwise direction is set to 50 mm. The nozzles 3 are arranged in 10 rows in the longitudinal direction in a zone with a distance of lm between table rolls.

With respect to a jetting speed and a water amount density of cooling water, the jetting speed of the upper surface cooling water is 9.0 m/s in Example 3 and 12.0 m/s in Example 4, and the jetting speed of the lower surface cooling water is 13.5 m/s in Example 3 and 18.0 m/s in Example 4. The water amount density of upper surface cooling water is 2.1 $m^3/(m^2 \cdot min)$ in Example 3 and 2.8 $m^3/(m^2 \cdot min)$ in Example 4, and the water amount density of lower surface cooling water is 2.8 $m^3/(m^2 \cdot min)$ in Example 3 and 4.2 $m^3/(m^2 \cdot min)$ in Example 4.

In both Examples 3 and 4, as shown in FIG. 10, after cooling the steel plate, cooling water is speedily drained from the upper and lower surfaces of the steel plate and, hence, cooling water which is supplied in a successive manner can easily penetrate a staying water film.

Accordingly, Examples 3 and 4 can ensure high cooling ability uniformly on both upper and lower surfaces of the steel plate. In this case, Examples 3 and 4 can acquire the uniform temperature distribution as shown in FIG. 7 in the widthwise direction. Cooling time necessary for decreasing a cooling stop temperature at the center of the steel plate in the plate widthwise direction to 560° C. is 2.5 seconds in Example 3 and 2.1 seconds in Example 4. Since the cooling rate is increased, an alloy content of steel necessary for obtaining high strength (for example, Mn or the like) can be reduced, thus realizing the reduction of a manufacturing cost.

The temperature distribution plate in the steel widthwise direction is 550 to 560° C. and takes the substantially uniform distribution as shown in FIG. 7 so that the strip temperature deviation (maximum temperature—minimum temperature) in the steel plate widthwise direction is small, that is, 10° C. As a result, the acceptance rate of a material test is high, that is, 99.5% and a yield is also sufficiently high.

To the contrary, as a Comparison Example 2, cooling equipment described in Japanese Patent Unexamined Publication 2004-66308 is used. In this cooling equipment, slit-shaped holes are formed in a dividing wall and the holes are used as water supply inlets as well as drain outlets. Conditions other than a shape of holes formed in the dividing wall are set equal to the conditions used in Examples 3 and 4. In the cooling equipment of Comparison Example 2,as shown in FIG. 9, it is difficult for cooling water to escape upward after impinging on the steel plate and, hence, water cooling time of 3 seconds is necessary for decreasing a cooling stop temperature at the center of the steel plate in the plate widthwise direction to 560° C.

The plate widthwise distribution of the cooling stop temperature forms a concave shape as shown in FIG. 6. The highest temperature in the vicinity of the plate edge portion is 600° C., and the strip temperature deviation (maximum temperature—minimum temperature) in the widthwise direction is 40° C. A part of the product is taken out and is subject to a material test. A result of the test shows that the acceptance rate is low, that is, 70% and a yield is also bad.

Figure 29:
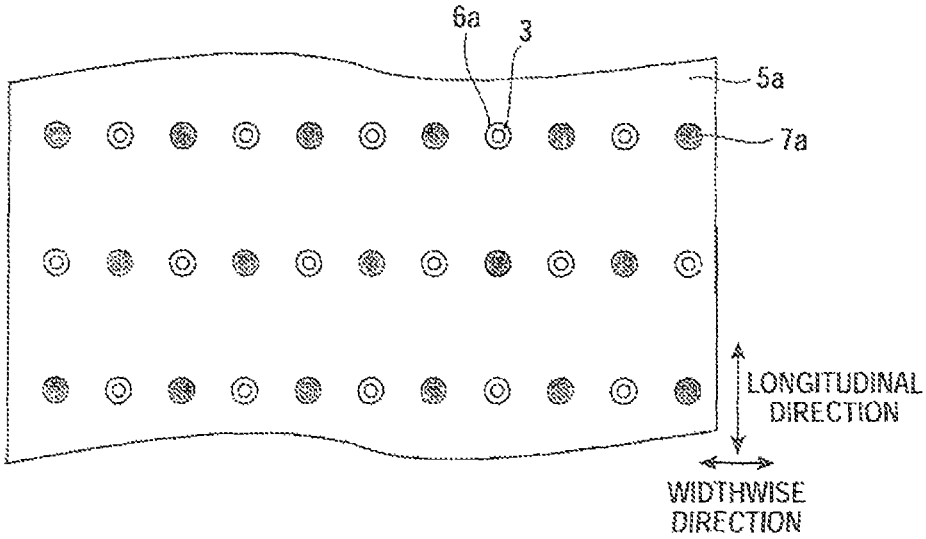
FIG. 29 shows a plan view showing one example of a dividing wall of a comparison example.

Further, as a Comparison Example 3, cooling is performed in a state where the cooling water quantity and the size of the nozzle are equal to the cooling water quantity and the size of the nozzle of Example 3 and the layout of the nozzles 3 and the upper drain outlets 7*a* are set as shown in FIG. 29. That is, in Comparison Example 3, the upper drain outlet 7*a* is arranged at an intermediate position between the upper water inlets 6*a*, that is, the circular tube nozzles 3 which are arranged parallel to each other in the widthwise direction. In Comparison Example 3, it is unnecessary to intentionally form a row of upper drain outlets 7*a* between a nozzle row and a nozzle row as in the case of Example 3 (see FIG. 22) so that Comparison Example 3 is considered as the most general-type to adopt as the layout of the upper drain outlets 7*a* formed in the upper dividing wall 5*a*.

However, cooling water which is jetted from two nozzles arranged adjacent to each other in the longitudinal direction has no place to escape and, hence, the drain property is bad compared to Example 3 whereby Comparison Example 3 is inferior to Example 3 in cooling ability. Cooling time necessary for decreasing a cooling stop temperature at the center of the steel plate in the plate widthwise direction to 560° C. is 2.8 seconds. The reduction of alloy content of steel necessary for obtaining high strength (for example, Mn or the like) turns out to be only approximately one half of the reduction of alloy content acquired by Example 3.

EXAMPLE 4

As an example of the fourth and fifth constructions, the explanation is made with respect to a case where cooling of a steel plate having a tensile stress of 590 MPa class is performed in a steel plate rolling process in conjunction with drawings.

With respect to steel plate rolling conditions, except for the cooling equipment described hereinafter, the all conditions used in this example are equal to the corresponding conditions used in Example 1.

The cooling equipment used in the accelerated cooling test is explained in conjunction with a case where the cooling equipment includes a dividing wall 5*a* and a dividing wall 5*b* on upper and lower surfaces of a steel plate 12 respectively as shown in FIG. 15 (Example 5) and a case where the cooling equipment includes an upper dividing wall 5*a* and a lower protector plate 22 on upper and lower surfaces of a steel plate 12 respectively as shown in FIG. 18 (Example 6).

The size of the nozzle is set such that the inner diameter is 5 mm, the outer diameter is 9 mm, and the pitch of the nozzles in the steel plate widthwise direction is set to 50 mm. The nozzles are arranged in 10 rows in the longitudinal direction in a zone with a distance of lm between table rolls. The jetting speed of the upper surface cooling water is 8.9 m/s, the water amount density of upper surface cooling water is 2.1 $m^3/(m^2 \cdot min)$, and the jetting speed of the lower surface cooling water is 8.9 m/s in Example 5 and 12.7 m/s in Example 6. The water amount density of lower surface cooling water is 2.1 $m^3/(m^2 \cdot min)$ in Example 5 and 3.0 $m^3/(m^2 \cdot min)$ in Example 6.

A lower end of the nozzle for upper surface cooling is arranged to assume an intermediate position between the upper and lower ends of the dividing wall having a plate thickness of 25 mm, and a distance to the upper surface of the steel plate from the lower end of the nozzle is set to 80 mm. In Example 5, an upper end of the nozzle for lower surface cooling is arranged to assume an intermediate position between the upper and lower ends of the dividing wall having a plate thickness of 25 mm, and a distance to the upper surface of the steel plate from the upper end of the nozzle is set to 80 mm. In Example 6, a distance to the lower surface of the steel plate from the upper end of the lower surface cooling nozzle is set to 120 mm.

Figure 19:
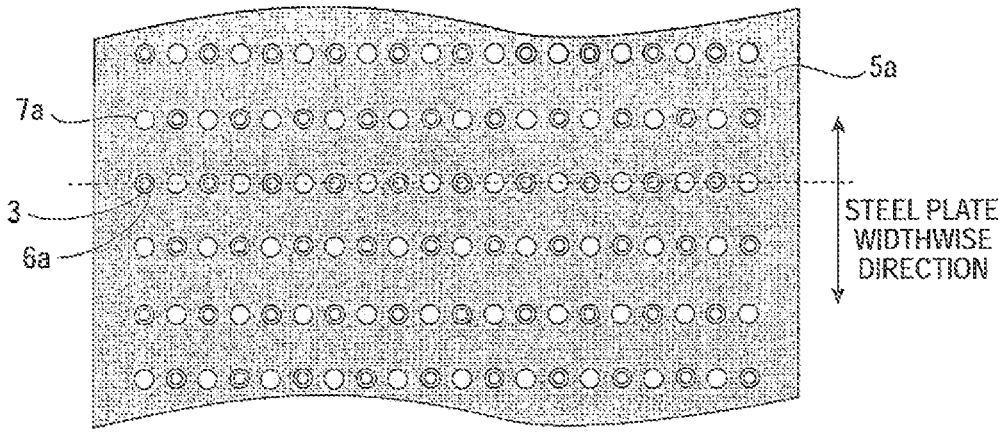
FIG. 19 shows a view explaining the arrangement of nozzles on an upper surface side.

Holes each having a diameter of 12 mm are formed in the upper dividing wall 5*a* and the lower dividing wall 5*b* in Example 5 and the upper dividing wall 5*a* in Example 6 in a check pattern and, as shown in FIG. 16, FIG. 17 and FIG. 19 respectively, the circular tube nozzles 3 and 4 are inserted into nozzle ports which are arranged in a staggered grid pattern, and remaining holes are used as drain outlets.

In Examples 5 and 6, as shown in FIG. 10, after cooling the upper surface of the steel plate, cooling water is speedily drained from the upper surface of the steel plate and, hence, cooling water supplied in a successive manner can easily penetrate a staying water film. After cooling the lower surface of the steel plate, in Example 6, cooling water directly falls between the nozzles so that cooling water does not hamper the jetting of cooling water supplied in a successive manner. In Example 5, water is filled between the lower surface of the steel plate and the lower dividing wall 5*b*. However, the jetting distance is short, that is, 80 mm and, hence, the cooling water can reach the lower surface of the hot-rolled steel plate by breaking the film of filled water.

Accordingly, Examples 5 and 6 can ensure high cooling ability on both upper and lower surfaces of the steel plate. In this case, the temperature distribution of the steel plate in the widthwise direction is 550 to 560° C. so that Examples 5 and 6 can acquire the uniform temperature distribution in the widthwise direction as shown in FIG. 7.

Even when the jetting is performed before the steel plate enters the cooling zone, cooling water jetted from the upper and lower headers do not collide with each other or do not scatter and, hence, the strip temperature deviation at a position 2 m away from the leading edge of the steel plate and the strip temperature deviation at a position 2 m away from the tailing edge of the steel plate fall within 10° C. Since the strip temperature deviation is small and, hence, the acceptance rate of a material test is high, that is, 99.5% and a yield is also sufficiently high.

Cooling time necessary for decreasing a cooling stop temperature at the center of the steel plate in the plate widthwise direction to 560° C. can be reduced to 2.5 seconds. Since the cooling rate becomes high, an alloy content of steel necessary for obtaining high strength (for example, Mn or the like) can be reduced thus realizing the reduction of a manufacturing cost.

The jetting lines of cooling water jetted from the upper and lower headers do not intersect with each other and, hence, there is no possibility that cooling waters jetted at a high speed before the hot-rolled steel plate 12 enters to the cooling zone scatter to the surrounding thus ensuring the favorable maintenance of equipment.

The lower end of the upper surface cooling nozzle 3 is arranged to assume an intermediate position between the upper and lower ends of the upper dividing wall 5*a*, the upper end of the lower surface cooling nozzle 4 is arranged to assume an intermediate position between the upper and lower ends of the lower dividing wall 5*b* in Example 5, and the lower protector plate 22 is provided in Example 6 and, hence, even when the hot-rolled steel plate 12 having the warped leading edge enters the cooling zone, there is no possibility that the nozzle is broken.

To the contrary, as a Comparison Example 4, cooling equipment described in Japanese Patent Unexamined Publication 2004-66308 is used. In that cooling equipment, slit-shaped holes are formed in a dividing wall. Conditions other than a shape of holes formed in the dividing wall and the arrangement that injection lines of upper and lower cooling water jetting nozzles are arranged to intersect with each other are set equal to the conditions used in the above-mentioned Example 5. In the cooling equipment of Comparison Example 4, as shown in FIG. 9, after impinging on the steel plate, it is difficult for cooling water to escape upward and, hence, water cooling time of 3 seconds is necessary for decreasing a cooling stop temperature at the center of the steel plate in the plate widthwise direction to 560° C.

The plate widthwise distribution of the cooling stop temperature forms a concave shape as shown in FIG. 6. The highest temperature in the vicinity of the plate edge portion is 600° C., and the strip temperature deviation (maximum temperature—minimum temperature) in the widthwise direction is 40° C.

When jetting of cooling water is performed before the steel plate enters the cooling zone, the cooling waters jetted from the upper and lower headers collide with each other so that the scattering of cooling water is vigorous. The scattered cooling water collapses the water flux of the cooling water around the scattered water. As a result, the cooling equipment cannot acquire the stable cooling ability so that the strip temperature deviation at a position 2 m away from the leading edge of the steel plate and the strip temperature deviation at a position 2 m away from the tailing edge of the steel plate become 40° C.

A part of the product is taken out and is subject to a material test. A result of the test shows that the acceptance rate is low, that is, 70% and a yield is also bad.

EXAMPLE 5

As another Example 5 (Example 7) of the third construction, the explanation is made with respect to a case where cooling equipment which has a dividing wall (upper dividing wall 5*a*) only on the upper surface of the steel plate as shown in FIG. 13 is used in a steel plate rolling process substantially equal to the steel plate rolling process in Example 4.

The size of the nozzle is set such that the inner diameter is 8 mm, the outer diameter is 11 mm, and the pitch of the nozzles in the steel plate widthwise direction is set to 50 mm. The nozzles are arranged in 10 rows in the longitudinal direction in a zone with a distance of lm between table rolls. The jetting speed of the upper surface cooling water is 6.3 m/s, the water amount density of upper surface cooling water is 3.8 $m^3/(m^2 \cdot min)$, and the jetting speed of the lower surface cooling water is 9.5 m/s, and the water amount density of lower surface cooling water is 5.7 $m^3/(m^2 \cdot min)$.

A lower end of the nozzle 3 for upper surface cooling is arranged to assume an intermediate position between the upper and lower ends of the upper dividing wall 5*a* having a plate thickness of 30 mm, and a distance to the upper surface of the steel plate from the lower end of the nozzle 3 is set to 50 mm. A distance from the upper end of the lower surface cooling nozzle 4 to the lower surface of the steel plate is set to 80 mm.

Holes each having a diameter of 11 mm and holes each having a diameter of 14 mm are formed in the dividing wall 5*a* in a check pattern and, as shown in FIG. 16, the circular tube nozzles 3 are inserted into the holes each having a diameter of 14 mm arranged in a staggered grid pattern as the upper water supply inlets, and remaining holes each having a diameter of 11 mm are used as drain outlets.

In Example 7, as shown in FIG. 10, water is speedily drained after cooling the upper surface of the steel plate and, hence, cooling water supplied in a successive manner can easily penetrate a staying water film. After cooling the lower surface of the steel plate, water directly falls between the nozzles so that water does not hamper the jetting of cooling water supplied in a successive manner.

Cooling time necessary for decreasing a cooling stop temperature at the center of the steel plate in the plate widthwise direction to 560° C. is 2.1 seconds, and the temperature distribution in the steel plate widthwise direction is 550 to 560° C. so that the temperature distribution assumes the substantially uniform distribution as shown in FIG. 7. Accordingly, the uniform cooling at a high cooling rate can be realized in the same manner as Examples 5 and 6.

Even when the jetting is performed before the steel plate enters the cooling zone, cooling waters jetted from the upper and lower headers 3, 4 do not collide with each other or do not scatter and, hence, the strip temperature deviation at a position 2 m away from the leading edge of the steel plate and the strip temperature deviation at a position 2 m away from the tailing edge of the steel plate fall within 10° C. Accordingly, advantageous effects similar to the advantageous effects of Examples 5 and 6 including the maintenance property of equipment are confirmed.

INDUSTRIAL APPLICABILITY

With the use of the cooling equipment of the steel material, the high thermal conductivity is achieved so that it is possible to bring the steel material to the target temperature earlier. That is, the cooling rate can be increased so that a new product such as a high strength steel plate can be developed, for example. Further, a cooling time of the steel plate can be shortened so that productivity can be enhanced by increasing a manufacture line speed, for example.

Further, the cooling of the upper surface of steel plate and/or the lower surface of the steel plate can be performed such that there is no strip temperature deviation in the steel plate widthwise direction and the steel plate can be uniformly cooled also in the steel plate longitudinal direction from the leading edge of the steel plate to the tailing edge of the steel plate whereby it is possible to manufacture the high-quality steel plate. Further, scattering of cooling water to the surrounding can be suppressed, the maintenance property of the peripheral equipment is also enhanced.

EXPLANATION OF SYMBOLS

1: upper header, 2: lower header, 3: upper cooling water jetting nozzle (circular tube nozzle), 4: lower cooling water jetting nozzle (circular tube nozzle), 5*a*: upper dividing wall, 5*b*: lower dividing wall, 6*a*: upper water-supply inlet, 6*b*: lower water-supply inlet, 7*a*: upper drain outlet, 7*b*: lower drain outlet, 8: jetting cooling water (or rod-like water flow), 9: drain water, 10: draining roll, 11: table roller; 12: steel plate, 21: water landing point; 22: protector plate

The invention claimed is:

1. Cooling equipment for a hot rolled steel plate which is arranged on a hot rolling line of a steel plate comprising:

an upper header which supplies cooling water to an upper surface of the hot rolled steel plate;

upper cooling water jetting nozzles suspended from the upper header that jet rod-shaped water flow; and an upper dividing wall arranged between the hot rolled steel plate and the upper header, a plurality of upper water-supply inlets formed in the upper dividing wall and which allow insertion of lower end portions of the upper cooling water jetting nozzles thereinto, and a plurality of upper drain outlets formed in the upper dividing wall and which drain cooling water supplied to the upper surface of the hot rolled steel plate, the upper drain outlets being separate from the upper water-supply inlets, and wherein the lower end of each upper cooling water jetting nozzle is inserted into an upper water-supply inlet of the upper dividing wall.

2. The cooling equipment according to claim 1, wherein the upper drain outlets are arranged at (a) the circumcenter of a triangle formed of three line segments which connect neighboring upper water-supply inlets to each other or (b) a bisection point of each side of the triangle.

3. The cooling equipment according to claim 1, wherein the upper drain outlets are arranged at (a) a median point of a quadrangle formed of four line segments which connect neighboring upper water-supply inlets to each other or (b) a bisection point of each side of the quadrangle.

4. The cooling equipment according to claim 1, wherein a) a cross-sectional area of the upper drain outlets formed in the upper dividing wall is not less than 1.5 times a total inner-diameter cross-sectional area of the upper cooling water jetting nozzles and b) a cross-sectional area of a flow passage in a steel-plate widthwise direction in a space surrounded by a lower surface of the upper header and an upper surface of the upper dividing wall is not less than 1.5 times a total inner-diameter cross-sectional area of the upper cooling water jetting nozzles.

5. The cooling equipment according to claim 1, wherein a draining roll is arranged in front of and behind the upper header.

6. The cooling equipment according to claim 1, wherein an inner diameter of the upper cooling water jetting nozzle is 3 to 8 mm, a length of the upper cooling water jetting nozzle is 120 to 240 mm, a distance from a lower end of the upper cooling water jetting nozzle to a surface of the hot rolled steel plate is 30 to 120 mm, a flow speed of the cooling water to be jetted from the upper cooling water jetting nozzles is 8 m/s or more, and water amount density of the cooling water to be jetted from the upper cooling water jetting nozzles is 1.5 to 4.0 $m^3/(m^2 \cdot min)$.

7. The cooling equipment according to claim 1, wherein a gap is defined between an outer peripheral surface of the upper cooling water jetting nozzle inserted into the upper water-supply inlet formed in the upper dividing wall and an inner surface of the upper water-supply inlet and a distance of the gap is not more than 3 mm.

8. The cooling equipment according to claim 1, wherein among the upper cooling water jetting nozzles arranged in a widthwise direction of the hot rolled steel plate, the cooling water jetting nozzles on a most upstream-side row in a conveyance direction of the hot rolled steel plate are inclined in an upstream direction in the conveyance direction of the hot rolled steel plate by 15 to 60 degrees, and the cooling water jetting nozzles on a most downstream-side row in the conveyance direction of the hot rolled steel plate are inclined in a downstream direction in the conveyance direction of the hot rolled steel plate by 15 to 60 degrees.

9. The cooling equipment according to claim 1, wherein the cooling equipment includes, on a lower surface side of the hot rolled steel plate, a lower header which supplies cooling water and lower cooling water jetting nozzles which jet rod-shaped water flow upward in the vertical direction from the lower header, and the lower cooling water jetting nozzles are arranged such that jetting lines from the lower cooling water jetting nozzles align with the upper drain outlets formed in the upper dividing wall.

10. The cooling equipment according to claim 9, further comprising a lower dividing wall between the lower header and the hot rolled steel plate on the lower surface side of the hot rolled steel plate, and a multiplicity of lower water-supply inlets which allows the insertion of upper end portions of the lower cooling water jetting nozzles thereinto and a multiplicity of lower drain outlets which drain cooling water supplied to the lower surface of the hot rolled steel plate under the lower dividing will are formed in the lower dividing wall, and the lower drain outlets which are formed in the lower dividing wall are arranged such that jetting lines from the upper cooling water jetting nozzles align with the lower drain outlets.

11. The cooling equipment according, to claim 9, further comprising a protector plate which protects the lower cooling water jetting nozzles on the lower surface side of the hot rolled steel plate, and arranged at a position which avoids jetting lines from the lower cooling water jetting nozzles and jetting lines from the upper cooling water jetting nozzles such that the an upper end or the protector plate is disposed closer to the hot rolled steel plate than upper ends of the lower cooling water jetting nozzles.

12. The cooling equipment according to claim 9, wherein an inner diameter of the upper cooling water jetting nozzle and an inner diameter of the lower cooling water jetting nozzle are 3 to 8 mm respectively, a flow speed of the cooling water to be jetted from the cooling water jetting nozzles is 6 m/s or more, water amount density of the cooling water on an upper surface side of the hot rolled steel plate is 1.5 to 4.0 $m^3/(m^2 \cdot min)$, and water amount density of the cooling water on a lower surface side of the hot rolled steel plate is 2.0 to 6.0 $m^3/(m^2 \cdot min)$.

13. The cooling equipment according to claim 10, wherein an inner diameter of the upper cooling water jetting nozzle and an inner diameter of the lower cooling water jetting nozzle are 3 to 8 mm respectively, a flow speed of the cooling water to be jetted from the cooling water jetting nozzles is 6 m/s or more, and water amount densities of the cooling water on an upper surface side and a lower surface side of the hot rolled steel plate are 1.5 to 4.0 $m^3/(m^2 \cdot min)$ respectively.

14. The cooling equipment according to claim 9, wherein among the lower cooling water jetting nozzles arranged in a widthwise direction of the hot rolled steel plate, the cooling water jetting nozzles on a most upstream-side row in a conveyance direction of the hot rolled steel plate are inclined in an upstream direction in the conveyance direction of the hot rolled steel plate by 15 to 60 degrees, and the cooling water jetting nozzles on a most downstream-side row in the conveyance direction of the hot rolled steel plate are inclined in the downstream direction in the conveyance direction of the hot rolled steel plate by 15 to 60 degrees.

15. A method of cooling a hot rolled steel plate comprising:

providing the cooling equipment according to claim 1;

supplying via the upper header cooling water to the upper surface of the hot rolled steel plate;

at the time of cooling the hot rolled steel plate after hot rolling, jetting rod-shaped water flow from the upper cooling water jetting nozzles suspended from the upper header onto the an upper surface of the hot rolled steel plate, wherein the lower end of each upper cooling water jetting nozzle is inserted into one of the plurality of the upper water-supply inlets of the upper dividing wall; and draining the cooling water supplied to the upper surface of the hot rolled steel plate via the plurality of upper drain outlets formed in the upper dividing wall, wherein the upper drain outlets are separate from the upper water-supply inlets.

16. Cooling equipment for a hot rolled steel plate which is arranged on a hot rolling line of a steel plate, wherein an upper header which supplies cooling water, upper cooling water jetting nozzles suspended from the upper header that jet rod-shaped water flow, and an upper dividing wall arranged between the hot rolled steel plate and the upper header arranged on an upper surface side of the hot rolled steel plate, wherein a multiplicity of upper water-supply inlets which allow insertion of lower end portions of the upper cooling water jetting nozzles thereinto, and a multiplicity of upper drain outlets which drain the cooling water supplied to an upper surface of the hot rolled steel plate on an upper dividing wall are formed in the upper dividing wall the upper drain outlets being separate from the upper water-supply inlets, and a lower header, which supplies cooling water and lower cooling water jetting nozzles that jet rod-shaped water flow upwardly in a vertical direction from the lower header are arranged on a lower surface side of the hot rolled steel plate such that jetting lines from the lower cooling water jetting nozzles align with the upper drain outlets formed in the upper dividing wall.

17. The cooling equipment according to claim 16, further comprising a lower dividing wall between the lower header and the hot rolled steel plate on a lower surface side of the hot rolled steel plate, and a multiplicity of lower water-supply inlets which allows the insertion of upper end portions of the lower cooling water jetting nozzles thereto and a multiplicity of lower drain outlets which drain cooling water supplied to the lower surface of the hot rolled steel plate formed in the lower dividing wall, and the lower drain outlets formed in the lower dividing wall are arranged such that jetting lines from the upper cooling water jetting nozzles align with the lower drain outlets.

18. The cooling equipment according to claim 16, further comprising a protector plate which protects the lower cooling water jetting nozzles on a lower surface side of the hot rolled steel plate, and the protector plate is arranged at a position which avoids jetting lines from the lower cooling water jetting nozzles and jetting lines from the upper cooling water jetting nozzles such that an upper end of the protector plate is disposed closer to the hot rolled steel plate than upper ends of the lower cooling water jetting nozzles.

19. The cooling equipment according to claim 16, wherein an inner diameter of the upper cooling water jetting nozzle and an inner diameter of the lower cooling water jetting nozzle are 3 to 8 mm respectively, a flow speed of the cooling water to be jetted from the cooling water jetting nozzles is 8 m/s or more, water amount density of the cooling water on an upper surface side of the hot rolled steel plate is 1.5 to 4.0 $m^3/(m^2 \cdot min)$, and water amount density of the cooling water on a lower surface side of the hot rolled steel plate is 2.0 to 6.0 $m^3/(m^2 \cdot min)$.

20. The cooling equipment according to claim 17, wherein an inner diameter of the upper cooling water jetting nozzle and an inner diameter of the lower cooling water jetting nozzle are 3 to 8 mm respectively, a flow speed of the cooling water to be jetted from the cooling water jetting nozzles is 8 m/s or more, and water amount densities of the cooling water on an upper surface side and a lower surface side of the hot rolled steel plate is 1.5 to $4.0 m^3/(m^2 \cdot min)$ respectively.

* * * * *